US009098006B2

(12) United States Patent
Uematsu et al.

(10) Patent No.: US 9,098,006 B2
(45) Date of Patent: Aug. 4, 2015

(54) ROLLER MEMBER FOR ELECTROPHOTOGRAPHY, PROCESS CARTRIDGE AND ELECTROPHOTOGRAPHIC APPARATUS

(71) Applicant: CANON KABUSHIKI KAISHA, Tokyo (JP)

(72) Inventors: Atsushi Uematsu, Fuji (JP); Noboru Miyagawa, Suntou-gun (JP); Taichi Sato, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/244,804

(22) Filed: Apr. 3, 2014

(65) Prior Publication Data

US 2014/0301754 A1 Oct. 9, 2014

Related U.S. Application Data

(63) Continuation-in-part of application No. 14/224,054, filed on Mar. 24, 2014, now abandoned.

(30) Foreign Application Priority Data

Apr. 3, 2013 (JP) ..... 2013-077702

(51) Int. Cl.

| | |
|---|---|
| ***G03G 15/02*** | (2006.01) |
| ***G03G 15/08*** | (2006.01) |
| ***G03G 15/16*** | (2006.01) |
| ***G03G 15/20*** | (2006.01) |

(52) U.S. Cl.

CPC ..... *G03G 15/0233* (2013.01); *G03G 15/0818* (2013.01); *G03G 15/1685* (2013.01); *G03G 15/2053* (2013.01)

(58) Field of Classification Search

CPC ..... G03G 15/0233; G03G 2215/025; G03G 15/0818

USPC ..... 399/176

See application file for complete search history.

(56) References Cited

FOREIGN PATENT DOCUMENTS

| | | |
|---|---|---|
| JP | 2008-276026 A | 11/2008 |
| JP | 2011-237470 A | 11/2011 |

*Primary Examiner* — David Bolduc
*Assistant Examiner* — Barnabas Fekete
(74) *Attorney, Agent, or Firm* — Fitzpatrick, Cella, Harper and Scinto

(57) ABSTRACT

The roller member has a substrate and an electroconductive elastic layer. The elastic layer has a crown shape of which an outer diameter at the middle in the lengthwise direction is larger than those at its both ends. The elastic layer includes a bowl-shaped resin particle. The surface of the roller member has concavity derived from an opening of the bowl-shaped resin particle and a protrusion derived from an edge of the opening of the resin particle. The relation in the restoring rate for elastic deformation between at the middle of the roller member and at its both ends is such that: on the surface of the elastic layer the restoring rate is larger at both ends than that at the middle, and at the position of depth t μm from the elastic layer surface the restoring rate is larger at the middle than that at both ends.

15 Claims, 5 Drawing Sheets

ROLLER MEMBER FOR ELECTROPHOTOGRAPHY, PROCESS CARTRIDGE AND ELECTROPHOTOGRAPHIC APPARATUS

CROSS-REFERENCE TO RELATED APPLICATIONS

This application is a continuation-in-part of U.S. patent application Ser. No. 14/224,054 filed on Mar. 24, 2014, which claims the benefit of Japanese Patent Application No. 2013-077702, filed Apr. 3, 2013.

BACKGROUND OF THE INVENTION

1. Field of the Invention

The present invention relates to a roller member used for electrophotography, a process cartridge using the roller member and an electrophotographic image forming apparatus (hereinafter, referred to as an "electrophotographic apparatus") using the roller member.

2. Description of the Related Art

An electrophotographic apparatus adopting an electrophotographic method is mainly composed of an electrophotographic photosensitive member (hereinafter, may be simply referred to as a "photosensitive member"), a charging device, an exposure device, a developing device, a transfer device and a fixing device. The roller member is suitably used in the charging device, the developing device, the transfer device and the fixing device. In the charging device, the roller member is disposed in contact with or close to the surface of the photosensitive member, and charges the surface of the photosensitive member electrically by the applying of a voltage (a voltage only of a direct-current voltage or a voltage of a direct-current voltage with an alternating-current voltage superposed thereon).

Japanese Patent Application Laid-Open No. 2008-276026 discloses a charging roller having protrusions derived from electroconductive resin particles, as a roller member (hereinafter, referred to as a "charging roller") for charging a photosensitive member electrically in such a way that the roller member is brought into contact with the photosensitive member.

However, in the charging roller according to Japanese Patent Application Laid-Open No. 2008-276026, when the charging roller comes into contact with the photosensitive member, pressure is concentrated on the protrusions derived from the resin particles, to result in non-uniform abrasion of the surface of the photosensitive member in use over a long term.

For such a problem, Japanese Patent Application Laid-Open No. 2011-237470 discloses a roller member including bowl-shaped resin particles having openings in the electroconductive resin layer thereof and having on the surface thereof a concave-convex shape derived from the openings and edges of the bowl-shaped resin particles. The roller member according to Japanese Patent Application Laid-Open No. 2011-237470 is described to be capable of suppressing the non-uniform abrasion of the photosensitive member even in use over a long term, due to the alleviation of the contact pressure as a result of the elastic deformation at the time when the edges of the bowl-shaped resin particles come into contact with the photosensitive member.

In the roller member according to Japanese Patent Application Laid-Open No. 2011-237470, the elastic deformation of the edges of the openings of the bowl-shaped resin particles alleviates the pressure of contact between the edges and the photosensitive member. For the above-described reason, the non-uniform abrasion of the surface of the photosensitive member is suppressed even in use of the photosensitive member over a long term. On the other hand, in the roller member according to Japanese Patent Application Laid-Open No. 2011-237470, there is a possibility that the performance of rotation of the roller member following-up the rotation of the photosensitive member (hereinafter, may be referred to as "follow-up rotation performance") is degraded.

Recently, with increase in process speed of electrophotographic apparatuses, there has been found a tendency such that when an electrophotographic image is formed, the photosensitive member involved tends to vibrate. When the photosensitive member in a state of vibration is to be charged by bringing a roller member which is low in the follow-up rotation performance into contact with the photosensitive member, the roller member may not follow-up the rotation of the photosensitive member to consequently cause such a phenomenon (hereinafter, also referred to as "stick-slip") that the roller member slips on the surface of the photosensitive member. The occurrence of the stick-slip causes charging unevenness on the photosensitive member to cause the occurrence of horizontal-line-like density unevenness on the electrophotographic image. Hereinafter, the horizontal-line-like density unevenness occurring on the electrophotographic image may be referred to as "banding." Additionally, an electrophotographic image on which the horizontal-line-like density unevenness occurs may be referred to as a "banding image."

SUMMARY OF THE INVENTION

Accordingly, the present invention is directed to providing a roller member capable of sufficiently suppressing the non-uniform abrasion of the photosensitive member and the occurrence of a banding image even in use over a long term. Also, the present invention is directed to providing a process cartridge and an electrophotographic apparatus conducive to the formation of high-quality electrophotographic images.

According to an aspect of the present invention, there is provided a roller member for electrophotography comprising: an electroconductive substrate and an electroconductive elastic layer as a surface layer;

wherein the electroconductive elastic layer has a crown shape of which an outer diameter at the middle of the roller member in the lengthwise direction is larger than those at both ends of the roller member;

the electroconductive elastic layer comprises a binder and a bowl-shaped resin particle;

the surface of the roller member has a concavity derived from an opening of the bowl-shaped resin particle and a protrusion derived from an edge of the opening of the bowl-shaped resin particle; and wherein the relation in the restoring rate of the roller member for elastic deformation between at the middle of the roller member in the lengthwise direction and at both ends of the roller member is such that:

on the surface of the electroconductive elastic layer, the restoring rate is larger at the both ends than that at the middle, and at the position of depth t μm from the surface of the electroconductive elastic layer, the restoring rate is larger at the middle than that at the both ends.

According to another aspect of the present invention, there is provided a process cartridge comprising the above roller member for electrophotography and an electrophotographic photosensitive member, and being constituted to be demountable from the body of an electrophotographic apparatus.

According to a further aspect of the present invention, there is provided an electrophotographic apparatus comprising the above roller member for electrophotography and an electrophotographic photosensitive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The roller member for electrophotography according to the present invention (hereinafter, may be simply referred to as a "roller member") has an electroconductive substrate and an electroconductive elastic layer. The electroconductive elastic layer has a crown shape of which an outer diameter at the middle of the roller member in the lengthwise direction is larger than those at the both ends of the roller member.

The electroconductive elastic layer includes a binder resin and a bowl-shaped resin particle. The surface of the roller member has a concavity derived from an opening of the bowl-shaped resin particle and a protrusion derived from an edge of the opening (hereinafter, sometimes simply referred to as "edge") of the bowl-shaped resin particle. The relation in the restoring rate of the roller member for elastic deformation between at the middle of the roller member in the lengthwise direction and at both ends of the roller member in the lengthwise direction is such that: on the surface of the electroconductive elastic layer, the restoring rate is larger at the both ends than that at the middle, and at the position of depth t μm from the surface of the electroconductive elastic layer, the restoring rate is larger at the middle than that at the both ends. In present Specification, the restoring rate for the elastic deformation of the roller member may be simply referred to as "restoring rate".

Figure 1A:
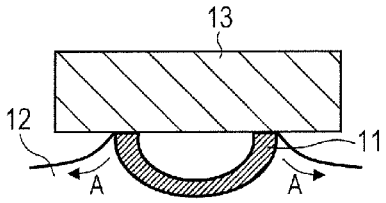
FIGS. 1A, 1B, 1C and 1D are diagrams illustrating the development of the effects of the roller member according to the present invention.

The protrusion derived from the edge more easily tend to undergo elastic deformation when the roller member comes into contact with the photosensitive member as compared to such protrusions due to the electroconductive resin particles as described in Japanese Patent Application Laid-Open No. 2008-276026. Accordingly, the contact pressure is alleviated. FIG. 1A is an enlarged schematic view of the close contact section (hereinafter, referred to as a "nip portion") between the roller member including the bowl-shaped resin particles illustrated in FIGS. 4A and 4B and the photosensitive member. In the nip portion, the contact pressure between the edge and the photosensitive member elastically deforms the edge in the directions of arrows A to result in alleviation of the contact pressure on the photosensitive member. The foregoing effect enables the suppression of the non-uniform abrasion of the photosensitive member even in use for an extended period of time.

On the other hand, the alleviation of the contact pressure may reduce the contact area between the roller member and the photosensitive member, degrade the driven rotation performance of the roller member in relation to the photosensitive member and cause charging unevenness to occur on the photosensitive member. Such charging unevenness can be a cause for the occurrence of banding images. Such a problem becomes more prominent in the case where the process speed is more increased, and the vibration of the photosensitive member becomes larger.

The roller member is disposed in relation to the photosensitive member driving the roller member in such a way that the roller member is brought into contact with the photosensitive member by applying a predetermined pushing pressure due to a spring or the like to both ends of the roller member, and thus the roller member is follow-up rotated with the rotation of the photosensitive member. In this case, if the roller member is of a usual cylindrical shape, structurally, the pressurization in the middle portion of the roller member comes to be weak, and there is a possibility of the occurrence of the gap between the photosensitive member and roller member. On the basis of the foregoing reason, for the purpose of bringing the roller member into contact with the photosensitive member with a pressure uniform in the lengthwise direction of the roller member, a roller member is suitably used which has a crown shape of which an outer diameter at the middle of the roller member in the lengthwise direction is larger than those at the both ends. By allowing the roller member to have a crown shape of which an outer diameter at the middle of the roller member in the lengthwise direction is larger than those at the both ends, the width of the close contact (hereinafter, referred to as a "nip width") between the middle of the roller member and the photosensitive member comes to be large, and hence the follow-up rotation performance in the middle of the roller member in relation to the photosensitive member is improved. The follow-up rotation performance is increasingly improved with the increase in the difference in the outer diameter between the middle and the both ends.

However, in case of a great difference in the outer diameter between the middle and the both ends in the lengthwise direction of the roller member, when the roller member is followed-up rotated with the rotation of the photosensitive member, the circumferential speed of the roller member comes to be larger at the both ends of the roller member than at the middle. Consequently, a "twist" is exerted on the elastic layer of the roller member, due to the difference in the circumferential speed between the middle and the both ends in the lengthwise direction. Although such a "twist" is absorbed by the elastic deformation to be caused in the elastic layer when the magnitude of the twist is small, the "twist" is continuously accumulated in the elastic layer, and when the accumulated twist exceeds a certain magnitude, the elastic layer takes an action to get back to the original state so as to release the force of the "twist," resulting in the occurrence of the slip of the roller member. Specifically, the stick-slip occurs at both end portions of the roller member. Consequently, charging unevenness occurs partially on the photosensitive member to result in the occurrence of a banding image.

For such a problem, the constitution of the roller member according the present invention enables to establish the compatibility between the suppression of the non-uniform abrasion of the photosensitive member and the suppression of the banding image due to the improvement of the follow-up rotation performance of the roller member in relation to the photosensitive member. The establishment of the compatibility is considered to be due to the effects described in the following 1) and 2).

1) The restoring rate of the elastic deformation of the electroconductive elastic layer of the roller member according to the present invention becomes larger on the surface of the electroconductive elastic layer, in the direction from the middle of the roller member toward the both ends in the lengthwise direction.

The bowl-shaped resin particles formed on the surface of the electroconductive elastic layer are in the state in which the edges 11 are elastically deformed due to the pressure of contact with the photosensitive member 13 in the directions of the arrows A in the nip portion as shown in FIG. 1A.

Figure 1B:
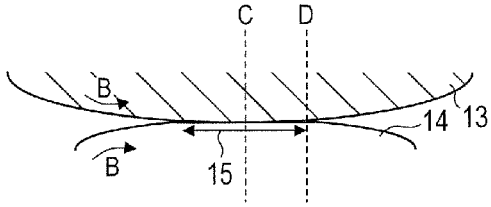
Figure 1C:
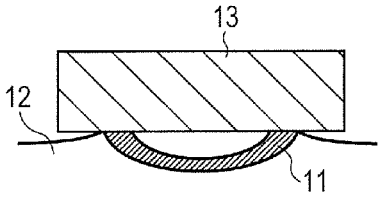
Figure 1D:
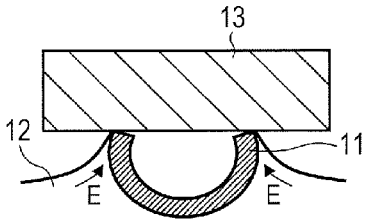

FIG. 1B is a schematic cross-sectional view of the nip portion. As shown in FIG. 1B, the roller member 14 is brought into contact with the photosensitive member 13 by a predetermined pushing pressure (not shown) due to, for example, a spring. Following the rotation of the photosensitive member in the direction of an arrow B, the roller member is driven to rotate in the direction of another arrow B. In this case, the contact pressure exerted by the photosensitive member on the roller member is the largest at the center (the position C) of the nip portion 15. Accordingly, the elastic deformation of the edge also becomes large as shown in FIG. 1C. Consequently, the contact area between the edge 11 and the photosensitive member surface is the largest in the nip portion. Subsequently, when the resin particles move to the termination (the position D) in the nip portion, the contact pressure exerting on the roller member and the bowl-shaped resin particles is decreased and the contact pressure is released when the resin particles depart from the nip portion. The state of the bowl-shaped resin particles in this case is shown in FIG. 1D. Specifically, the elastic deformation of the edge 11 is restored in the direction of an arrow E in FIG. 1D to reduce the contact area between the edge and the photosensitive member. The present inventors have discovered that the restoring rate of the elastic deformation of the edges 11 of the bowl-shaped resin particles due to the decrease and the release of the contact pressure exerted on the bowl-shaped resin particles depends on the restoring rate of the elastic deformation of the surface region of the electroconductive elastic layer 12 holding the resin particles. Specifically, the present inventors have discovered that the higher the restoring rate from the elastic deformation of the surface region of the electroconductive elastic layer 12 is, the higher the restoring rate from the elastic deformation of the edge portion of the bowl-shaped resin particles is.

Accordingly, for the surface region of the electroconductive elastic layer 12, the present inventors have tried to make larger the restoring rate at both ends in the lengthwise direction of the roller member as compared to the restoring rate in the middle in the lengthwise direction of the roller member. As a result, the restoring rate immediately after the passage of the edges of the bowl-shaped resin particles through the nip portion is considered to become larger at both ends of the roller member than at the middle in the lengthwise direction. Consequently, immediately after the passage through the nip portion, the state of contact between the edges of the bowl-shaped resin particles and the photosensitive member is as shown in FIG. 1D at both ends in the lengthwise direction of the roller member and is as shown in FIG. 1A in the middle in the lengthwise direction of the roller member. The attainment of such a state reduces, at both ends, the contact area between the protrusions derived from the edges and the photosensitive member, and consequently, the frictional force between the surface of the electroconductive elastic layer and the photosensitive member is decreased at both ends as compared to in the middle. In this case, the force of the "twist" due to the circumferential speed difference between the middle and the both ends of the roller member comes to be hardly accumulated at both ends, in the lengthwise direction, of the electroconductive elastic layer of the roller member. The occurrence of the stick-slip to cause the charging unevenness can be considered to be consequently suppressed.

On the other hand, the restoring rate of the elastic deformation of the edges of the bowl-shaped resin particles is slower at the middle of the roller member in the lengthwise direction than at the both ends to result in the suppression of the reduction of the contact area between the protrusions of the surface of the roller member and the photosensitive member immediately after the passage through the nip portion. Consequently, the follow-up rotation performance of the roller member in relation to the photosensitive member is maintained satisfactorily.

2) The restoring rate of the elastic deformation at the position of a predetermined depth t μm from the surface of the electroconductive elastic layer of the roller member according to the present invention becomes larger in the direction from the both ends of the roller member toward the middle in the lengthwise direction of the roller member.

As described in the foregoing 1), the restoring rate of the elastic deformation in the surface region of the electroconductive elastic layer mainly contributes to the state of contact between the edges of the bowl-shaped resin particles in the surface of the roller member and the photosensitive member. On the contrary, the restoring rate of the elastic deformation at the position of the predetermined depth t μm from the surface is considered to contribute to the substantial nip width.

When the roller member 14 is driven to rotate following-up the rotation of the photosensitive member 13, the contact pressure becomes maximum at the center (the position C) of the nip portion 15 in FIG. 1B. The roller member is deformed by the contact pressure, and hence the outer diameter of the roller member becomes minimum at the position C. Subsequently, the contact pressure is decreased when the roller member rotates to move to the termination (the position D in FIG. 1B) of the nip portion, and hence the outer diameter of the roller member is restored. In the outermost termination end region (the dotted-line frame F) of the nip portion in FIG.

Figure 2A:
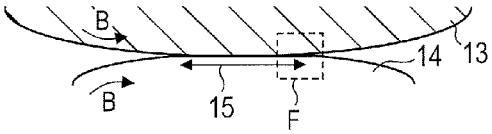
FIGS. 2A and 2B are diagrams illustrating the development of the effects of the roller member according to the present invention.
Figure 2B:
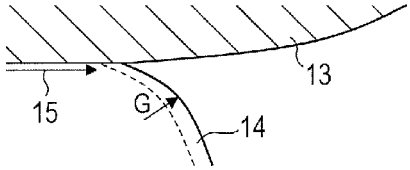

2A, the restoration of the outer diameter occurs in the direction of an arrow G in FIG. 2B. In the case where the restoring rate of the outer diameter of the roller member in the outermost termination end region is fast, the state in which the surface of the roller member and the surface of the photosensitive member are in close contact with each other continues over a longer period of time as compared to the case where the restoring rate is slow. This effect works as if the nip width were increased.

In the roller member according to the present invention, the restoring rate of the elastic deformation in the deep layer part of the electroconductive elastic layer, namely, in the part of a depth of t μm from the surface is larger at the middle of the roller member in the lengthwise direction than at the both ends. For the reason, the restoring rate of the outer diameter of the electroconductive elastic layer in the outermost termination end region of the nip portion is made faster at the middle of the roller member in the lengthwise direction than at the both ends. Therefore, the substantial nip width is larger at the middle than at the both ends. Consequently, the number of the contact points at which the edges are in contact with the photosensitive member is larger at the middle in the lengthwise direction of the roller member and is smaller at the both ends. Specifically, the contact area between the protrusions derived from the edges and the photosensitive member is larger at the middle and is smaller at the both ends in the lengthwise direction of the roller member, and hence the frictional force (grip property) between the middle in the lengthwise direction of the roller member having a crown shape and the photosensitive member is improved. Consequently, the follow-up rotation performance of the roller member in relation to the photosensitive member can be improved.

Here, the restoring rate for the elastic deformation of the electroconductive elastic layer in regard to the present invention is described. The restoring rate of the elastic deformation of the electroconductive elastic layer according to the present invention is determined by the following method. Specifically, by using a microhardness tester based on the indentation test method according to ISO 14577 (Metallic materials-Indentation test for hardness and material parameters), an indenter is made to sink in the electroconductive elastic layer in a predetermined magnitude (D μm) by applying a load to the indenter. Hereinafter, the predetermined magnitude may be referred to as "indentation depth." Examples of the microhardness tester include "PICODENTER HM500" (trade name, manufactured by Fischer Instruments KK).

Figure 12:
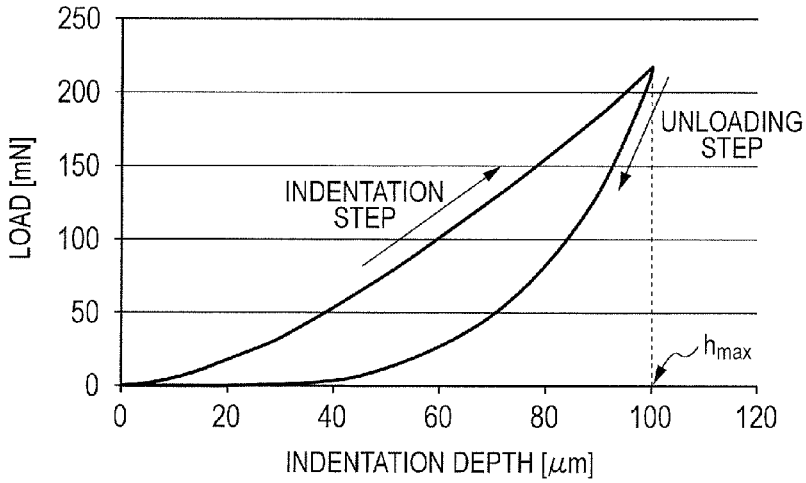
FIG. 12 is an example of a load-displacement curve for the roller member according to the present invention.

Subsequently, the load applied to the indenter is unloaded, and the restored distance (μm) of the elastic layer is calculated based on the force exerted on the indenter by the elastic layer in the unloading step. Thus, as shown in FIG. 12, a graph is obtained which shows the relations between the load (mN) applied to the indenter, the indentation depth (μm) and the restored distance (μm) of the elastic layer at the time of unloading.

When the restored distance of the elastic layer immediately after the start of the unloading, more specifically, after 0.1 second from the start of the unloading is represented by L μm, the restoring rate v (μm/sec) is found based on the following calculation formula (1):

$$\text{Restoring rate } v\ (\mu m/sec) = L\ (\mu m)/0.1\ (sec) \quad (1)$$

The reason for the use of the restored distance L after 0.1 second from the start of the unloading in the calculation of the restoring rate is as follows. Specifically, in the outermost termination end region of the nip portion, the restoring rate immediately after the surface region of the electroconductive elastic layer is released from the contact pressure is considered to control the restoring rate from the elastic deformation of the edges of the bowl-shaped resin particles. Similarly, in the outermost termination region of the nip portion, the restoring rate immediately after the deep layer region of the electroconductive elastic layer is released from the contact pressure is considered to control the substantial nip width. Accordingly, in the present invention, the restoring rate immediately after the electroconductive elastic layer of the roller member is released from the contact pressure, calculated by using the restored distance after 0.1 second from the start of the unloading of the electroconductive elastic layer, is regarded as the restoring rate of the electroconductive elastic layer.

The surface region according the present invention is defined as the region of a depth of 10 μm from the face of the electroconductive elastic layer opposite to the face thereof facing the electroconductive substrate, that is, from the surface of the electroconductive elastic layer. This is because the restoration from the elastic deformation of the edges, described in 1), is considered to be substantially controlled by the restoring rate of the electroconductive elastic layer in the region of a depth of 10 μm from the surface of the electroconductive elastic layer. Accordingly, the indentation depth D μm of the indenter of the microhardness tester is preferably set to be 10 μm.

Additionally, in the present invention, the target value for the depth t μm from the face of the electroconductive elastic layer opposite to the face thereof facing the electroconductive substrate, that is, from the surface of the electroconductive elastic layer, which depth defines the deep layer region of the electroconductive elastic layer, is preferably 30 μm or more and 100 μm or less. By setting the value of t μm so as to fall within this range, the effect of the increase of the substantial nip width in the middle in the lengthwise direction of the roller member can be more certainly achieved in a favorable manner. In other words, within this depth range, the restoring rate of the electroconductive elastic layer is preferably larger at the middle in the lengthwise direction of the roller member than at the both ends. For that purpose, the indentation depth D μm in the measurement of the restoring rate of the deep layer region of the electroconductive elastic layer according the present invention is preferably set to be 20 to 100 μm.

<Roller Member>

Figure 3A:
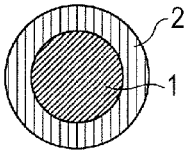
FIGS. 3A and 3B are cross-sectional views of the roller member according to the present invention.
Figure 3B:
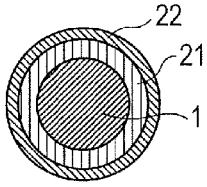

Hereinafter, the roller member according the present invention is described in detail. FIGS. 3A and 3B are schematic views of examples of the cross-sectional views of the roller member according to the present invention. The roller member of FIG. 3A has an electroconductive substrate 1 and an electroconductive elastic layer 2. As shown in FIG. 3B, the electroconductive elastic layer may be a two-layered configuration composed of electroconductive elastic layers 21 and 22. The electroconductive elastic layers each include a binder, electroconductive fine particles and bowl-shaped resin particles.

The electroconductive substrate and the electroconductive elastic layer, or layers (such as electroconductive elastic layer 21 and electroconductive elastic layer 22 shown in FIG. 3B) sequentially laminated on the electroconductive substrate may be allowed to adhere to each other through the intermediary of an adhesive. In this case, the adhesive is preferably electroconductive. As the adhesive for electroconduction, known adhesives can be used.

Examples of the binder of the adhesive include thermosetting resins and thermoplastic resins; as the binder, heretofore known binders such as urethane-based, acrylic, polyester-based, polyether-based, epoxy-based binders can be used.

An electroconductive agent to impart electroconductivity to the adhesive is appropriately selected from the below-described electroconductive fine particles which can be used to make the elastic layer electroconductive, and the selected electroconductive fine particles can be used alone or in a combination of two or more.

The roller member according the present invention is preferably of a crown shape in which the roller member is thickest at the middle in the lengthwise direction and becomes thinner towards both ends of the roller member, from the viewpoint of improving the follow-up rotation performance of the roller member at the middle in the lengthwise direction in relation to the photosensitive member. A preferable range of the "crown quantity" is from 30 to 200 μm. The crown quantity is the difference between the outer diameter D2 at the middle in the lengthwise direction of the roller member and the mean value of the outer diameters D1 and D3 at the positions separated by 90 mm from the middle toward both ends; thus, the crown quantity is a value derived based on the following calculation formula (2):

$$\text{Crown quantity}=D2-(D1+D3)/2 \quad (2)$$

[Electroconductive Substrate]

The electroconductive substrate used for the roller member of the present invention has electroconductivity and has a function to support the electroconductive elastic layer or the like formed thereon. Examples of the materials of the substrate may include: metals such as iron, copper, stainless steel, aluminum and nickel; and alloys of these metals.

[Electroconductive Elastic Layer]

Figure 4A:
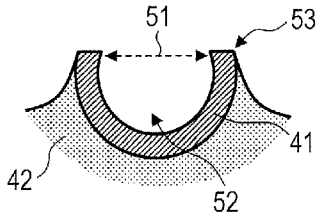
FIGS. 4A and 4B are partial cross-sectional views of the vicinity of the surface of the roller member according to the present invention.
Figure 4B:
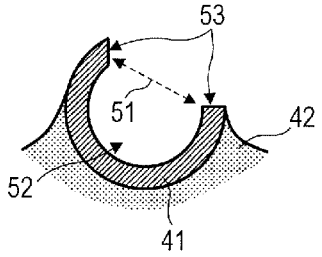

FIGS. 4A and 4B are partial cross-sectional views of the vicinity of the surface of the electroconductive elastic layer of the roller member. A part of the bowl-shaped resin particles 41 included in the electroconductive elastic layer is partially exposed to the surface of the roller member. The surface of the roller member has the concavities 52 derived from the openings 51 of the bowl-shaped resin particles exposed to the surface and the protrusions derived from the edges 53 of the openings of the bowl-shaped resin particles exposed to the surface.

Figure 5:
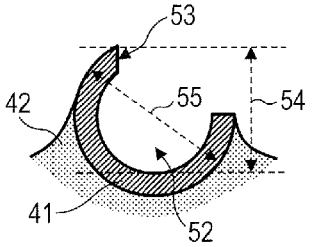
FIG. 5 is a partial cross-sectional view of the vicinity of the surface of the roller member according to the present invention.

With reference to FIG. 5, the distance 54 between the top of the protrusion 53 derived from the edge of the opening of the bowl-shaped resin particle and the bottom of the concavity 52 demarcated by the shell of the bowl-shaped resin particle is preferably set to be 5 μm or more and 100 μm or less and particularly preferably 8 μm or more and 80 μm or less. Hereinafter, the foregoing distance may be referred to as "height difference." The distance 54 set within the foregoing range more certainly enables the alleviation of the contact pressure. The ratio between the height difference 54 and the maximum diameter 55 of the bowl-shaped resin particle, namely, [maximum diameter]/[height difference] of the resin particle is preferably 0.8 or more and 3.0 or less. The foregoing ratio set within the foregoing range more certainly enables the reduction of the above-described contact pressure.

The formation of the foregoing concave-convex shape preferably controls as described below the surface state of the roller member, namely, the surface state of the electroconductive elastic layer. The ten-point average roughness (Rzjis) is preferably 5 μm or more and 65 μm or less, in particular, 10 μm or more and 50 μm or less. The mean concave-convex spacing (Sm) of the surface is preferably 30 μm or more and 200 μm or less, in particular, 40 μm or more and 150 μm or less. The adoption of the foregoing ranges more certainly enables the reduction of the contact pressure. The measurement methods for the ten-point average roughness (Rzjis) of the surface and the mean concave-convex spacing (Sm) of the surface are described in detail below.

Figure 6A:
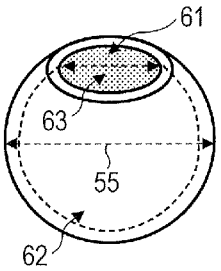
FIGS. 6A, 6B, 6C, 6D and 6E are diagrams illustrating the shapes of bowl-shaped resin particles according to the present invention.
Figure 6B:
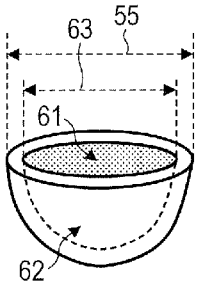
Figure 6C:
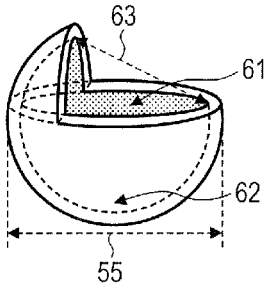
Figure 6D:
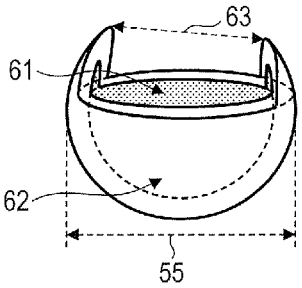
Figure 6E:
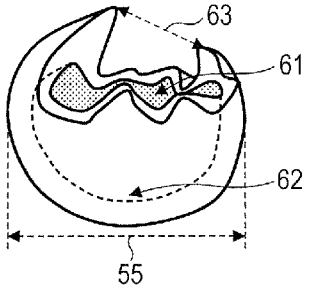

FIGS. 6A to 6E illustrate examples of the bowl-shaped resin particles used in the present invention. In the present invention, the "bowl-shaped" particle means a particle having an opening 61 and a roundish concavity 62 demarcated by a shell. The opening may have a smooth edge as illustrated in FIG. 6A and FIG. 6B, or an uneven edge as illustrated in FIG. 6C to FIG. 6E.

The maximum diameter 55 of the bowl-shaped resin particles is 5 μm or more and 150 μm or less, in particular, 8 μm or more and 120 μm or less. The ratio between the maximum diameter 55 of the bowl-shaped resin particles and the minimum diameter 63 of the opening, namely, the ratio [maximum diameter]/[minimum diameter of opening] of the bowl-shaped resin particles is preferably 1.1 or more and 4.0 or less. The foregoing ratio set to fall within the foregoing range more certainly enables the reduction of the above-described contact pressure.

The thickness of the shell of the bowl-shaped resin particles is preferably 0.1 μm or more and 3 μm or less, in particular, 0.2 μm or more and 2 μm or less. The thickness of the shell set to fall within this range enables more flexible elastic deformation of the edge, and consequently, more certainly enables the alleviation of the contact pressure. With respect to the thickness of the shell, the maximum thickness is preferably three or less times the minimum thickness and more preferably two or less times the minimum thickness.

[Binder]

As the binder included in the electroconductive elastic layer of the present invention, heretofore known rubbers or resins can be used. Examples of the rubber include natural rubber and natural rubber subjected to vulcanization, and synthetic rubbers. Examples of the synthetic rubbers include the following: ethylene propylene rubber, styrene butadiene rubber (SBR), silicone rubber, urethane rubber, isopropylene rubber (IR), butyl rubber, acrylonitrile butadiene rubber (NBR), chloroprene rubber (CR), acrylic rubber, epichlorohydrin rubber and fluororubber. Examples of the resins include resins such as thermosetting resins and thermoplastic resins. Among these, fluororesin, polyamide resin, acrylic resin, polyurethane resin, acrylic urethane resin, silicone resin and butyral resin are more preferable. These may be used each type alone or as mixtures of two or more types. Alternatively, the monomers which are the materials for these binders may be copolymerized to be converted into copolymers.

[Electroconductive Fine Particle]

The electroconductive elastic layer includes heretofore known electroconductive fine particles for the purpose of developing electroconductivity. Examples of the electroconductive fine particles include metal oxides, metal fine particles and carbon black. These electroconductive fine particles can be used each type alone or in combinations of two or more types. The standard value of the content of the electroconductive fine particles in the electroconductive elastic layer is 2 to 200 parts by mass, in particular, 5 to 100 parts by mass in relation to 100 parts by mass of the binder.

[Method for Forming Electroconductive Elastic Layer]

A method for forming the electroconductive elastic layer is exemplified as follows. First, on the electroconductive substrate, a coating layer (hereinafter, referred to as "preliminary coating layer") is prepared in which electroconductive fine particles and hollow-shaped resin particles are dispersed in a binder. Subsequently, the hollow-shaped resin particles are partially scraped away by polishing the surface of the particles to form a bowl shape, and the concavities derived from the openings of the resulting bowl-shaped resin particles and the protrusions derived from the edges of the openings of the resulting bowl-shaped resin particles are formed. Hereinafter, the shape including these concavities and protrusions is referred to as "concave-convex shape derived from the openings of the bowl-shaped resin particles". In this way, the electroconductive resin layer is formed, and then the surface of the electroconductive resin layer is subjected to electron beam irradiation to control the restoring rate of the elastic deformation of the electroconductive elastic layer.

[Dispersion of Resin Particles in Preliminary Coating Layer]

First, a method for dispersing the hollow-shaped resin particles in the preliminary coating layer is described. Such a method can be exemplified by a method in which a coating film of an electroconductive resin composition prepared by dispersing hollow-shaped particles containing gas in the interior thereof together with the binder and the electroconductive fine particles is formed on the electroconductive substrate, the coating film is subjected to, for example, drying, curing or cross-linking. Examples of the material used for the hollow-shaped resin particles may include the above-described heretofore known resins.

Another method can be exemplified by a method which uses a so-called thermally expandable microcapsule including an encapsulated substance in the interior of particles and becoming hollow-shaped resin particles due to the expansion of the encapsulated substance by heating. Specifically, this is a method in which an electroconductive resin composition is prepared in which a thermally expandable microcapsule is dispersed together with a binder and electroconductive fine particles, and then an electroconductive substrate is coated with the prepared composition, and the composition coating is, for example, dried, cured or cross-linked. In the case of this method, the hollow-shaped resin particles can be formed by expanding the encapsulated substance with the heat at the time of drying, curing or cross-linking of the binder used in the preliminary coating layer. In this case, by controlling the temperature condition, the particle size can be controlled.

When a thermally expandable microcapsule is used, a thermoplastic resin is required to be used as the binder. Examples of the thermoplastic resin include the following: acrylonitrile resin, vinyl chloride resin, vinylidene chloride resin, methacrylic acid resin, styrene resin, urethane resin, amide resin, methacrylonitrile resin, acrylic acid resin, acrylic acid ester resins and methacrylic acid ester resins. Among these, it is preferable to use a thermoplastic resin including at least one selected from acrylonitrile resin, vinylidene chloride resin and methacrylonitrile resin being low in gas permeability and exhibiting high impact resilience. These thermoplastic resins can be used each alone or in combinations of two or more thereof. Moreover, the monomers being the raw materials for these thermoplastic resins may be copolymerized to produce copolymers.

As the substance to be encapsulated in a thermoplastic microcapsule, a substance is preferable which turns into gas and expands at a temperature equal to or lower than the softening point of the thermoplastic resin. Examples of such a substance include the following: low boiling point liquids such as propane, propylene, butene, normal butane, isobutane, normal pentane and isopentane; and high boiling point liquids such as normal hexane, isohexane, normal heptane, normal octane, isooctane, normal decane and isodecane.

The thermally expandable microcapsule can be produced by heretofore known production methods such as a suspension polymerization method, an interfacial polymerization method, an interfacial sedimentation method and a liquid drying method. For example, the suspension polymerization method can be exemplified by a method in which a polymerizable monomer, a substance to be encapsulated in the thermally expandable microcapsule and a polymerization initiator are mixed together, the resulting mixture is dispersed in an aqueous medium including a surfactant and a dispersion stabilizer, and then the mixture is allowed to undergo suspension polymerization. A compound having a reactive group to react with a functional group of a polymerizable monomer, an organic filler can also be added.

The polymerizable monomer can be exemplified by the following: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate; acrylic acid esters (methyl acrylate, ethyl acrylate, n-butyl acrylate, isobutyl acrylate, t-butyl acrylate, isobornyl acrylate, cyclohexyl acrylate, benzil/benzyl acrylate); methacrylic acid esters (methyl methacrylate, ethyl methacrylate, n-butyl methacrylate, isobutyl methacrylate, t-butyl methacrylate, isobornyl methacrylate, cyclohexyl (meth)acrylate, benzil/benzyl methacrylate); styrene-based monomers, acrylamide, substituted acrylamide, methacrylic amide, substituted methacrylic amide, butadiene, ϵ-caprolactam, polyether and isocyanate. These polymerizable monomers can be used each alone or in combinations of two or more thereof.

As the polymerization initiator, an initiator soluble in the polymerizable monomer is preferable, and heretofore known peroxide initiators and azo initiators can be used. Among these, azo initiators are preferable. Examples of the azo initiator are listed below: 2,2'-azobisisobutyronitrile, 1,1'-azobis (cyclohexane-1-carbonitrile) and 2,2'-azobis(4-methoxy-2, 4-dimethylvaleronitrile). Among these, 2,2'-azobisisobutyronitrile is preferable. When a polymerization initiator is used, the amount of the polymerization initiator is preferably 0.01 to 5 parts by mass in relation to 100 parts by mass of the polymerizable monomer.

As the surfactant, an anionic surfactant, a cationic surfactant, a nonionic surfactant, an amphoteric surfactant and a polymeric dispersant can be used. The amount used of the surfactant is preferably 0.01 to 10 parts by mass in relation to 100 parts by mass of the polymerizable monomer.

Examples of the dispersion stabilizer include the following: organic fine particles (such as polystyrene fine particle, polymethyl methacrylate fine particle, polyacrylic acid fine particle and polyepoxide fine particle), silica (such as colloidal silica), calcium carbonate, calcium phosphate, aluminum hydroxide, barium carbonate, and magnesium hydroxide. The amount used of the dispersion stabilizer is preferably 0.01 to 20 parts by mass in relation to 100 parts by mass of the polymerizable monomer.

The suspension polymerization is preferably conducted by using a pressure resistant vessel under a sealed condition. The polymerization raw materials are suspended with, for example, a disperser, then the resulting suspension is transferred into a pressure resistant vessel and may be allowed to undergo suspension polymerization, or alternatively, the suspension operation may be performed in the pressure resistant vessel. The polymerization temperature is preferably 50° C. to 120° C. The polymerization may be performed under atmospheric pressure; however, in order to prevent the vaporization of the substance to be encapsulated in the thermally expandable microcapsule, the polymerization is preferably performed under a pressurized condition (under a pressure of atmospheric pressure plus 0.1 to 1 MPa). After the completion of the polymerization, solid-liquid separation and cleaning may also be performed by centrifugal separation or filtration.

When solid-liquid separation or cleaning is performed, subsequently, drying or crushing may also be performed at a temperature equal to or lower than the softening temperature of the resin constituting the thermally expandable microcapsule. Drying and crushing can be performed by known methods; a flash dryer, a downwind dryer and a Nauta mixer can be used. Drying and crushing can also be simultaneously performed with a crushing dryer. The surfactant and the dispersion stabilizer can be removed by repeating cleaning and filtration after production.

[Method for Forming Preliminary Coating Layer]

Successively, a method for forming the preliminary coating layer is described. Examples of the method for forming the preliminary coating layer include a method in which a layer of an electroconductive resin composition is formed on an electroconductive substrate by an application method such as electrostatic spray application, dipping application or roll application, and then, the layer is cured by drying, heating or cross-linking. Alternatively, such examples also include a method in which a sheet-shaped or tube-shaped layer, prepared by forming a film of the electroconductive resin composition so as to have a predetermined thickness and by curing the film, is allowed to adhere to the electroconductive substrate, or the substrate is coated with the resulting layer. Additionally, the preliminary coating layer can also be formed by placing the electroconductive resin composition in a mold with the electroconductive substrate disposed therein, and then curing the composition. In particular, when the binder is rubber, the preliminary coating layer can also be prepared, by using an extruder equipped with a cross head die, and by integrally extruding the electroconductive substrate and an unvulcanized rubber composition. Here, the cross head die is an extrusion die used as disposed at the tip of the cylinder of an extruder for the purpose of forming the coating layer of an electric wire or a wire.

Subsequently, after the drying, curing, cross-linking or the like, the surface of the preliminary coating layer is polished to partially scrape away the hollow-shaped resin particles to form bowl shapes. As the polishing method, a cylinder polishing method and a tape polishing method can be used. A cylinder polishing machine can be exemplified by a traverse type NC cylinder polishing machine and a plunge cut-type NC cylinder polishing machine.

(a) Case where the Thickness of Preliminary Coating Layer is Five or Less Times the Average Particle Size of Hollow-Shaped Resin Particles In the case where the thickness of the preliminary coating layer is five or less times the average particle size of the hollow particles, the protrusions derived from the hollow-shaped resin particles are often formed on the surface of the preliminary coating layer. In this case, the protrusions of the hollow-shaped resin particles are partially scraped away to form bowl shapes, and thus the concave-convex shape due to the openings of the bowl-shaped resin particles can be formed. In this case, it is preferable to use tape polishing in which the pressure exerted on the preliminary coating layer at the time of polishing is relatively small. As an example, the preferable ranges as the polishing conditions of the preliminary coating layer in the case where a tape polishing method is adopted are presented below.

The polishing tape is a tape obtained by dispersing polishing abrasive grains in a resin and by applying the resulting dispersion on a sheet-like substrate. The polishing abrasive grain can be exemplified by aluminum oxide, chromium oxide, silicon carbide, iron oxide, diamond, cerium oxide, corundum, silicon nitride, silicon carbide, molybdenum carbide, tungsten carbide, titanium carbide and silicon oxide. The average particle size of the polishing abrasive grain is preferably 0.01 μm or more and 50 μm or less and more preferably 1 μm or more and 30 μm or less. The average particle size of the polishing abrasive grain is the median diameter D50 measured by a centrifugal sedimentation method. The preferable range of the grit number of the polishing tape having the polishing abrasive grains falling within the foregoing preferable range is 500 or more and 20000 or less, and the more preferable range is 1000 or more and 10000 or less. Specific examples of the polishing tape include the following: MAXIMA LAP and MAXIMA T type (trade names, manufactured by Ref-Lite Co., Ltd.), Lapika (trade name, manufactured by Kovax Corp.), Microfinishing Film and Lapping Film (trade names, manufactured by Sumitomo 3M Ltd.), Mirror Film and Lapping Film (trade names, manufactured by Sankyo Rikagaku Co., Ltd.), and Mipox (trade name, manufactured by Nihon Micro Coating Co., Ltd.).

The traveling speed of the polishing tape is preferably 10 mm/min or more and 500 mm/min or less and more preferably 50 mm/min or more and 300 mm/min or less. The press-on pressure of the polishing tape to the preliminary coating layer is preferably 0.01 MPa or more and 0.4 MPa or less and more preferably 0.1 MPa or more and 0.3 MPa or less. In order to control the press-on pressure, a backup roller may be allowed to come into contact with the preliminary coating layer through the intermediary of the polishing tape. In order to obtain an intended shape, the polishing treatment may be performed over a plurality of times. The number of rotations is preferably set at 10 rpm or more and 1000 rpm or less and more preferably 50 rpm or more and 800 rpm or less. By adopting the foregoing conditions, the concave-convex shape due to the opening of the bowl-shaped resin particles can be more easily formed on the surface of the preliminary coating layer. Even when the thickness of the preliminary coating layer falls within the foregoing range, the concave-convex shape due to the opening of the bowl-shaped resin particles can be formed by the method described below in (b).

(b) Case where the Thickness of Preliminary Coating Layer Exceeds Five Times the Average Particle Size of Hollow-Shaped Resin Particles In the case where the thickness of the preliminary coating layer exceeds five times the average particle size of the hollow-shaped resin particles, a case occurs in which no protrusions derived from the hollow-shaped resin particles are formed on the surface of the preliminary coating layer. In such a case, by taking advantage of the polishability difference between the hollow-shaped resin particles and the preliminary coating layer, the concave-convex shape due to the opening of the bowl-shaped resin particles can be formed. The hollow-shaped resin particle encapsulates gas in the interior thereof, and hence has a high impact resilience. On the contrary, as the binder for the preliminary coating layer, a rubber or a resin having a relatively low impact resilience and a small stretch is selected. Herewith, a state can be achieved in which the preliminary coating layer is easily polished and the hollow-shaped resin particles are hardly polished. When the preliminary coating layer in the foregoing state is polished, the hollow-shaped resin particles are not polished in the same state as the state of the preliminary coating layer, but the hollow-shaped resin particles are allowed to have the bowl shape in which the hollow-shaped resin particles are only partially scraped away. Herewith, on the surface of the preliminary coating layer, the concave-convex shape due to the opening of the bowl-shaped resin particles can be formed. This method is a method in which the concave-convex shape is formed by taking advantage of the polishability difference between the hollow-shaped resin particles and the preliminary coating layer, and hence it is preferable to use a rubber as the binder used in the preliminary coating layer. Among rubbers, from the viewpoint of having a low impact resilience and a small stretch, it is particularly preferable to use acrylonitrile butadiene rubber, styrene butadiene rubber and butadiene rubber. As the resin used for the hollow-shaped resin particles, from the viewpoint of being low in gas permeability and having a high impact resilience, a polar group-containing resin is preferable, and a resin having the unit represented by the following formula (1) is more preferable. In particular, from the viewpoint that the polishability is easily controlled, a resin having the unit represented by formula (1) and the unit represented by formula (5) is even more preferable.

Formula (1)

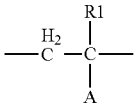

In formula (1), A is at least one group selected from the following formulas (2), (3) and (4). R1 is a hydrogen atom or an alkyl group having 1 to 4 carbon atoms.

Formula (2)

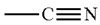

Formula (3)

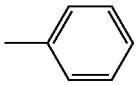

Formula (4)

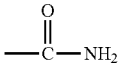

Formula (5)

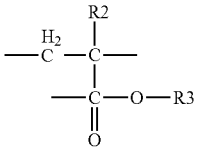

In formula (5), R2 is a hydrogen atom or an alkyl group having 1 to 4 carbon atoms. R3 is a hydrogen atom or an alkyl group having 1 to 10 carbon atoms. R2 and R3 may be of the same structure or structures different from each other.

[Polishing Method]

As the polishing method, a cylinder polishing method or a tape polishing method can be used; the polishability difference between the materials are required to be markedly accentuated, and hence a condition of faster polishing is preferable. From this viewpoint, it is more preferable to use the cylinder polishing method. Among the various types of the cylinder polishing method, it is furthermore preferable to use the plunge cutting method from the viewpoint that the positions in the lengthwise direction of the electroconductive roller can be simultaneously polished and the polishing time can be reduced. From the viewpoint that the polished surface is made uniform, it is preferable to make as short as possible the time for the spark-out step (polishing step at a penetration rate of 0 mm/min) having hitherto been performed or not to perform the spark-out step. As an example, the number of rotations of the cylindrical grinding wheel of the plunge cutting method is preferably 1000 to 4000 rpm, in particular, 2000 to 4000 rpm. The penetration rate into the preliminary coating layer is preferably 5 to 30 mm/min, and in particular, more preferably 10 to 30 mm/min. In the final stage of the penetration step, a step of conditioning may be applied to the polishing surface, and the step of conditioning is preferably performed at a penetration rate of 0.1 to 0.2 mm/min for within 2 seconds. The spark-out step (polishing step at a penetration rate of 0 mm/min) is preferably performed for 3 seconds or less. The number of rotations is preferably set at 50 rpm or more and 500 rpm or less and more preferably set at 200 rpm or more. By adopting the forgoing conditions, the concave-convex shape due to the opening of the bowl-shaped resin particles can be more easily formed on the surface of the preliminary coating layer, and the electroconductive roller having the electroconductive elastic layer can be prepared.

[Electron Beam Irradiation]

The surface of the electroconductive roller thus obtained is irradiated with an electron beam by the method described in the following (1), (2) or (3) to be subjected to curing treatment. Herewith, the roller member of the present invention can be obtained in which the restoring rates of elastic deformation of the middle and both ends in the lengthwise direction have the specific relation with each other.

(1) An electron beam irradiation method by fan-like scanning of electron beam with the middle in the lengthwise direction of the electroconductive roller as the irradiation center so as to extend the irradiation range toward both ends in the lengthwise direction of the electroconductive roller.

(2) An electron beam irradiation method by varying the acceleration voltage so as to be larger in the middle and smaller at both ends in the lengthwise direction of the electroconductive roller (3) An electron beam irradiation method with partial masking in the lengthwise direction of the electroconductive roller by varying the acceleration voltage The restoring rate of elastic deformation can be measured by the method in which the restoring rate for the elastic deformation is derived from the load-displacement curve obtained from the step of unloading after a Vickers indenter is indented to the predetermined depth with the below-described pico-indenter. The predetermined depth t μm is preferably 30 μm or more and 100 μm or less.

[Electron Beam Irradiation Apparatus]

Figure 7:
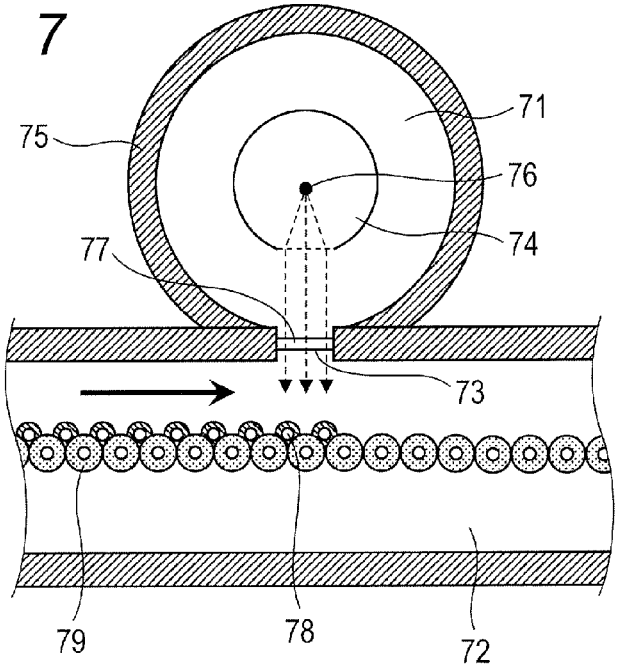
FIG. 7 is a diagram illustrating an electron beam irradiation apparatus used for the production of the roller member according to the present invention.

A schematic view of a common electron beam irradiation apparatus is shown in FIG. 7. The electron beam irradiation apparatus used in the present invention is an apparatus capable of irradiating with electron beam the surface of the electroconductive roller while the electroconductive roller is being rotated, and is provided with an electron beam generating section 71, an irradiation chamber 72 and an irradiation opening 73 as shown in FIG. 7.

The electron beam generating section 71 has an acceleration tube 75 for accelerating the electron beam generated in an electron source (electron gun) 74 in a vacuum space (acceleration space). The interior of the electron beam generating section is maintained in a vacuum of $10^{-3}$ to $10^{-6}$ Pa, with a not-shown vacuum pump or the like, in order to prevent electrons from losing energy by the collision with gas molecules.

When a filament 76 is heated by applying an electric current to the filament 76 with a not-shown electric power source, the filament 76 emits thermal electrons, and the thermal electrons are effectively taken out as the electron beam. After the electron beam is accelerated by the acceleration voltage in the acceleration space in the acceleration tube 75, the electron beam pierces through the irradiation opening foil 77 and is allowed to irradiate the electroconductive roller 78 being conveyed in the irradiation chamber 72 beneath the irradiation opening 73.

In the case where the electroconductive roller 78 is irradiated with an electron beam as it is the case in the present embodiment, the interior of the irradiation chamber 72 is made to have a nitrogen atmosphere. The electroconductive roller 78 is rotated with a roller rotating member 79 and is moved in the irradiation chamber by a convey unit from the left side to the right side in FIG. 7. The periphery of the electron beam generating section 71 and the periphery of the irradiation chamber 72 are shielded with a not-shown lead or stainless steel so as for the X-ray secondarily generated at the time of electron beam irradiation not to leak to outside.

The irradiation opening foil 77 is made of a metal foil, and serves as a partition between the vacuum atmosphere inside the electron beam generating section and the nitrogen atmosphere inside the irradiation chamber; the electron beam is taken out into the inside of the irradiation chamber through the intermediary of the irradiation opening foil 77. Accordingly, the irradiation opening foil 77 disposed in the boundary between the electron beam generating section 71 and the irradiation chamber 72 desirably has no pinhole, has a mechanical strength capable of sufficiently maintaining the vacuum atmosphere inside the electron beam generating section and easily allows the electron beam to transmit therethrough. For that purpose, the irradiation opening foil 77 is preferably a metal foil small in specific gravity and thin in thickness; usually, as the irradiation opening foil 77, aluminum foil, titanium foil, beryllium foil and carbon film are used. For example, a thin film foil having a thickness of about 5 μm or more and 30 μm or less is used. The conditions of the curing treatment with electron beam are determined by the acceleration voltage and the dose of the electron beam. The acceleration voltage affects the curing treatment depth, and the condition of the acceleration voltage in the present invention is preferably such that the acceleration voltage falls within a low energy region, a range from 40 to 300 kV. The acceleration voltage of 40 kV or more enables to obtain a treatment region sufficiently thick for attaining the advantageous effect of the present invention. A more preferable acceleration voltage falls within a range from 70 to 150 V.

The dose of the electron beam in the electron beam irradiation is defined by the following calculation formula (3):

$$D=(K\cdot I)/V \tag{3}$$

Here, D represents the dose (kGy), K represents the apparatus constant, I represents the electronic current (mA), and V represents the processing speed (m/min). The apparatus constant K is a constant representing the efficiency of the respective apparatus and an index indicating the performance of the apparatus. The apparatus constant K can be determined by measuring the does by varying the electronic current and the processing speed under a predetermined condition of the acceleration voltage. The measurement of the dose of the electron beam is performed by attaching a dose measurement film on the surface of the electroconductive roller, irradiating the surface of the electroconductive roller with the electron beam, and measuring the dose of the dose measurement film with a film dosimeter. The dose measurement film FWT-60 and the film dosimeter model FWT-92 (both manufactured by Far West Technology, Inc.) are used.

The dose of the electron beam in the present invention preferably falls within a range from 30 to 3000 kGy. When the dose is 30 kGy or more, the restoring rate for an elastic deformation sufficient for obtaining the advantageous effect of the present invention can be obtained. The dose set to be 3000 kGy or less does not harden the electroconductive elastic layer to an unnecessarily high hardness, and improves the follow-up rotation performance in relation to the photosensitive member.

[Scanning Electron Beam Irradiation Source]

Figure 8:
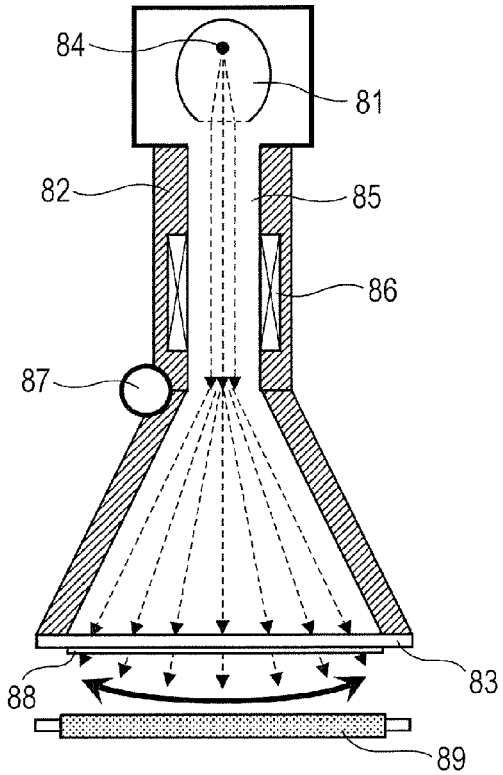
FIG. 8 is a diagram illustrating a scanning electron beam irradiation source used for the production of the roller member according to the present invention.

Next, the scanning electron beam irradiation source usable in the present invention is described in detail. As shown in FIG. 8, the scanning electron beam irradiation source is provided with an electron gun 81, a vessel 82 of the electron beam generating section and an irradiation opening 83. The scanning electron beam irradiation source is an apparatus for performing electron beam irradiation by radiating electron beam from an irradiation opening 83 while the electron beam is being scanned in a fan-like scanning mode by fast deflecting the electron beam emitted from the electron gun 81 to a predetermined direction.

The electron gun 81 has a filament 84 for emitting electron beam. An electromagnetic coil 86 is disposed around the electron beam passage hole 85 along the emitting axis of the electron beam emitted from the filament 84. The disposition center of the electromagnetic coil 86 coincides with the central axis of the electron beam passage hole 85. The electromagnetic coil is designed to focus the electron beam passing through the electron beam passage hole 85 toward the irradiation opening 83. A not-shown vacuum pump is connected to the side of the vessel 82 of the electron beam generating section, and the interior of the electron beam generating section is maintained in a vacuum of $10^{-3}$ to $10^{-6}$ Pa, in order to prevent electrons from losing energy by the collision with gas molecules.

The vessel 82 of the electron beam generating section is provided with a deflection coil, the electron beam passing through the electron beam passage hole 85 is deflected in a fan-like spread by the deflection coil 87. The deflection coil 87 is operated based on the electric current value and the frequency supplied from a not-shown alternating current electric power source, and consequently, the electron beam is fast deflected from side to side as shown in FIG. 8. The frequency of the deflected electron beam is preferably set at 100 Hz or more in order not to cause the occurrence of the electron beam irradiation unevenness.

The electron beam deflected in a fan-like spread by the deflection coil 87 transmits the irradiation window 88 disposed at the irradiation opening 83, and the surface of the electroconductive roller 89 disposed outside the scanning electron beam irradiation source is irradiated with the electron beam. The irradiation window 88 of the electron beam is formed with, for example, a titanium foil or a beryllium foil having a thickness of a few microns to about 10 μm.

By performing the surface treatment of the electroconductive elastic layer with the scanning electron beam irradiation source, the electroconductive elastic layer according the present invention can be obtained in which the restoring rates for the elastic deformation at the surface and at the position of the depth of t μm from the surface are reversed in the middle and at both ends in the lengthwise direction.

Specifically, as shown in FIG. 8, the electron beam irradiation is performed in a fan-like spread with the middle in the lengthwise direction of the electroconductive roller as the irradiation center so as to symmetrically extend the irradiation range toward both ends of the electroconductive elastic layer of the electroconductive roller. Herewith, the electron beam with which the middle in the lengthwise direction of the electroconductive elastic layer is irradiated and the electron beam with which both ends in the lengthwise direction of the electroconductive elastic layer are irradiated are the same with respect to the acceleration voltage, but these electron beams are different in the incident angle to the electroconductive elastic layer, and hence are different in the extent of the permeation of the electron beam in the depth direction of the electroconductive elastic layer. Consequently, the electron beam permeates more deeply in the middle than at both ends in the lengthwise direction of the electroconductive elastic layer.

Consequently, the roller member according the present invention, provided with the following properties 1) to 3) can be obtained.

1) The restoring rate for the elastic deformation of the electroconductive elastic layer is smaller from the surface toward the depth direction of the electroconductive elastic layer.

2) The restoring rates in the middle and at both ends in the lengthwise direction of the electroconductive elastic layer are such that the values at both ends are larger than the value in the middle on the surface of the electroconductive elastic layer.

3) The restoring rate at the position of the depth of t μm from the surface of the electroconductive elastic layer is such that the value in the middle is larger than the values at both ends.

Moreover, the roller member according the present invention can also be obtained by performing the electron beam irradiation in a fan-like spread by using the scanning electron beam irradiation window, while the acceleration voltage is being controlled to be higher in the middle and to be lower at both ends in the lengthwise direction of the electroconductive roller.

[Area-Type Electron Beam Irradiation Source]

Figure 9:
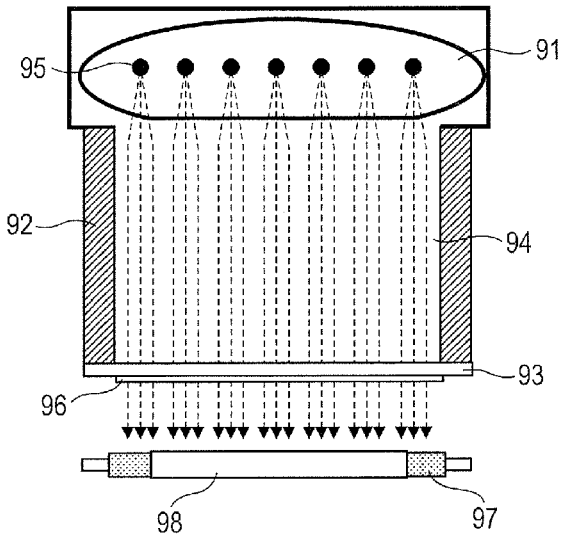
FIG. 9 is a diagram illustrating an area-type electron beam irradiation source used for the production of the roller member according to the present invention.

Next, the area-type electron beam irradiation source usable in the present invention is described in detail. As shown in FIG. 9, the area-type electron beam irradiation source is provided with an electron gun 91, a vessel 92 of the electron beam generating section and an irradiation opening 93. The area-type electron beam irradiation source is an apparatus in which the electron beam emitted from the electron gun 91 is accelerated by an acceleration tube 94 in the vacuum space (acceleration space), and the electron beam is radiated linearly from an irradiation opening 93 to irradiate a predetermined area.

The electron gun 91 has a plurality of filaments 95 to emit electron beams. The electron beams emitted by the plurality of filaments 95 are accelerated by an acceleration tube 94 in the vacuum space (acceleration space), and are radiated toward an irradiation opening 93. A not-shown vacuum pump is connected to the side of the vessel 92 of the electron beam generating section, and the interior of the electron beam generating section and the acceleration tube 94 are each maintained in a vacuum of $10^{-3}$ to $10^{-6}$ Pa, in order to prevent electrons from losing energy by the collision with gas molecules.

The linear electron beams emitted from the plurality of filaments 95 transmit through the window 96 disposed in the irradiation opening 93, and the surface of the roller member 97 disposed outside the area-type electron beam irradiation source is irradiated with the electron beams. The irradiation window 96 of the electron beams is formed with, for example, a titanium foil or a beryllium foil having a thickness of a few microns to about 10 μm.

The use of the area-type electron beam irradiation source enables the control of the restoring rate for the elastic deformation in the depth direction of the electroconductive elastic layer. Specifically, as shown in FIG. 9, a masking 98 is performed on the surface of the electroconductive roller, except for the predetermined width (for example, 10 mm) at each of both ends in the lengthwise direction of the electroconductive roller, and the electroconductive roller is irradiated with the electron beams having a low acceleration voltage. Subsequently, the masking 98 is performed on the surface of the electroconductive roller while the non-masking sections are being sequentially moved each by the predetermined width toward the middle, and the irradiation can be achieved by performing the irradiation repeatedly in such a way that every time the non-masking sections are moved, the acceleration voltage is gradually made higher.

By adopting such a masking operation, both ends of the electroconductive roller can be irradiated with the electron beam having a low acceleration voltage, and the middle of the electroconductive roller can be irradiated with the electron beam having a high acceleration voltage. Consequently, the distances of reach of the electron beam in the depth direction of the electroconductive elastic layer in the middle and at both ends can be varied. The masking 98 on the surface of the electroconductive roller prevents the transmission of the electron, and as the masking 98, for example, a stainless steel sheet having a thickness of about 50 μm is used.

As described above, the roller member according the present invention provided with the foregoing properties 1) to 3) can be obtained.

<Electrophotographic Apparatus>

The electrophotographic apparatus according the present invention is an electrophotographic apparatus including the roller member for electrophotography and a photosensitive member.

Figure 10:
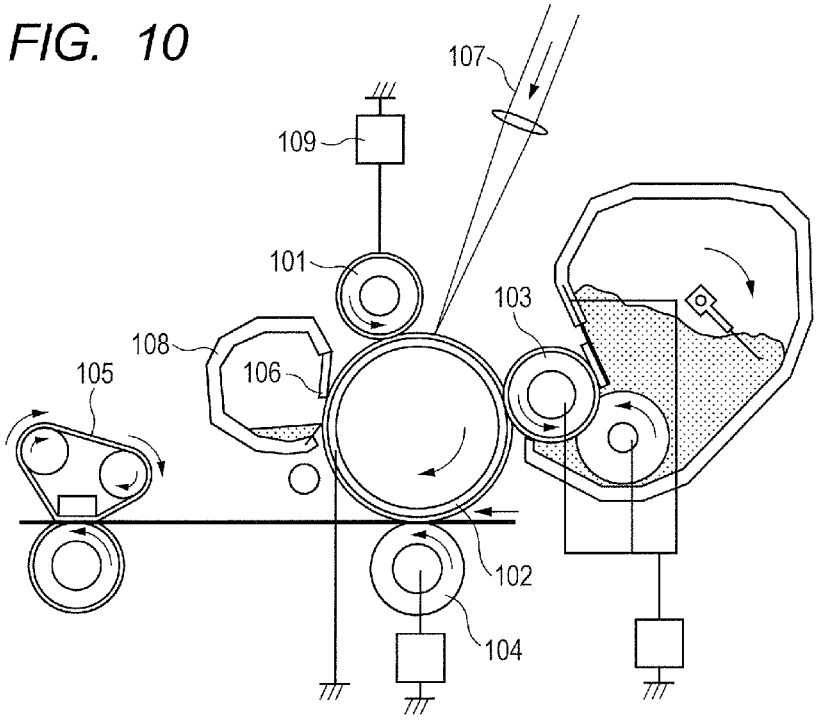
FIG. 10 is a schematic cross-sectional view illustrating an example of the electrophotographic apparatus according to the present invention.

FIG. 10 shows a schematic configuration of an example of the electrophotographic apparatus. The electrophotographic apparatus is constituted with, for example, an electrophotographic photosensitive member, a charging device of the electrophotographic photosensitive member, a latent image forming device performing photographic exposure, a developing device, a transfer device, a cleaning device for transfer residual toner on the electrophotographic photosensitive member and a fixing device.

The electrophotographic photosensitive member 102 is of a rotation drum type having a photosensitive layer on an electroconductive substrate. The electrophotographic photosensitive member is driven to rotate in the direction of an arrow at a predetermined peripheral speed (process speed).

The charging device has a contact-type charging roller 101 to be contact disposed with the electrophotographic photosensitive member 102 by being made to come into contact with the electrophotographic photosensitive member 102 with a predetermined pressure. The charging roller 101 is a driven rotation member which rotates following the rotation of the electrophotographic photosensitive member 102, and charges the electrophotographic photosensitive member to a predetermined electric potential by applying a predetermined direct-current voltage from a charging electric power source 109 to the electrophotographic photosensitive member. As the latent image forming device (not shown) forming an electrostatic latent image on the electrophotographic photosensitive member 102, an exposure device such as a laser beam scanner is used. An electrostatic latent image is formed by irradiating the uniformly charged electrophotographic photosensitive member 102 with the photographic exposure light 107 corresponding to image information.

The developing device has a development sleeve or a development roller 103 disposed in the vicinity of or in contact with the electrophotographic photosensitive member 102. By using a toner electrostatically treated so as to have the same polarity as the charge polarity of the electrophotographic photosensitive member and by performing reverse development, the electrostatic latent image is developed to form a toner image. The transfer device has a contact-type transfer roller 104. The toner image is transferred from the electrophotographic photosensitive member to a transfer material such as plain paper. The transfer material is conveyed by a paper feeding system having a conveying member.

The cleaning device has a blade-type cleaning member 106 and a collecting vessel 108, and mechanically scrapes off and collects, after the transfer, the transfer residual toner remaining on the electrophotographic photosensitive member 102. Here, the cleaning device can also be omitted by adopting a simultaneous development and cleaning method collecting the transfer residual toner with the developing device. The fixing roller 105 is constituted with a heated roller, fixes the transferred toner image on the transfer material, and mechanically discharges the transfer material with the transferred image thereon.

The roller member for electrophotography of the present invention can be used as the foregoing development roller, charging roller, transfer roller or fixing roller.

<Process Cartridge>

The process cartridge according the present invention has the roller member for electrophotography and an electrophotographic photosensitive member, and is a process cartridge constituted so as to be demountable from the body of an electrophotographic apparatus.

Figure 11:
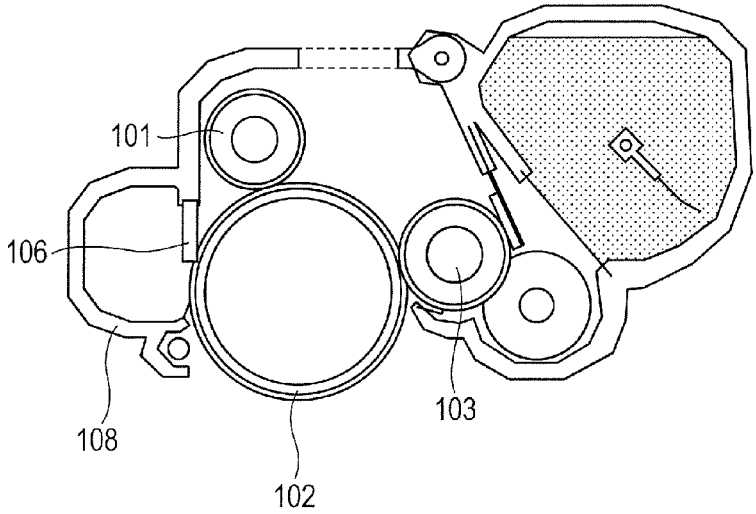
FIG. 11 is a schematic cross-sectional view illustrating an example of the process cartridge according to the present invention.

FIG. 11 shows a schematic configuration of an example of the process cartridge. The process cartridge is constituted by integrating, for example, the electrophotographic photosensitive member 102, the charging roller 101, the development roller 103 and the cleaning member 106, so as to be demountable from the electrophotographic apparatus. The roller member for electrophotography of the present invention can be used as the foregoing development roller or charging roller.

EXAMPLES

Hereinafter, the present invention is described in more detail with reference to specific Production Examples and Examples. Production examples are classified as follows. Production Examples 1 to 13 are production examples for resin particles. Production Examples 14 to 18 are production examples for electroconductive rubber compositions 1 to 5 including resin particles. The average particle size of the resin particles means a volume average particle size, and the measurement method thereof is described below in detail.

[Measurement of Volume Average Particle Size of Resin Particles]

The measurement of the volume average particle size of a powder was performed by using a laser diffraction particle size distribution analyzer (trade name: Coulter LS-230 Particle Size Distribution Analyzer, manufactured by Coulter, Inc.). For the measurement, an aqueous module was used, and pure water was used as the solvent. The interior of the measurement system of the particle size distribution analyzer was cleaned with pure water for about 5 minutes, 10 mg to 25 mg of sodium sulfite was added as an antifoaming agent in the measurement system, and the background function was performed. In 50 ml of pure water, 3 drops to 4 drops of a surfactant was added, and further, 1 mg to 25 mg of a measurement sample was added. An aqueous solution in which the sample had been suspended was subjected to a dispersion treatment with an ultrasonic disperser for 1 minute to 3 minutes to prepare a test sample solution. The measurement was performed in such a way that the test sample solution was slowly added in the measurement system of the measurement apparatus, and the test sample concentration in the measurement system was regulated so as for the PIDS on the screen of the apparatus to be 45% or more and 55% or less. From the obtained volume distribution, the volume average particle size was derived.

Production Example 1

Preparation of Resin Particles 1

An aqueous mixed liquid composed of 4000 parts by mass of ion-exchange water, 9 parts by mass of colloidal silica as a dispersion stabilizer and 0.15 part by mass of polyvinylpyrrolidone was prepared. Next, an oily mixed liquid was prepared which was composed of 50 parts by mass of acrylonitrile, 45 parts by mass of methacrylonitrile and 5 parts by mass of methyl methacrylate as polymerizable monomers, 12.5 parts by mass of normal hexane as an encapsulated substance, and 0.75 part by mass of dicumyl peroxide as a polymerization initiator. The oily mixed liquid was added to the aqueous mixed liquid, and additionally, 0.4 part by mass of sodium hydroxide was added to prepare a dispersion.

The obtained dispersion was stirred and mixed with a homogenizer for 3 minutes, and then the dispersion was placed in a polymerization reaction vessel the air in which had been replaced with nitrogen and allowed to react at 60° C. for 20 hours under stirring at 200 rpm to prepare a reaction product. The obtained reaction product was repeatedly filtered and washed with water, and then dried at 80° C. for 5 hours to prepare resin particles. The obtained resin particles were disintegrated and classified with a sonic classifier to yield the resin particles 1 having an average particle size of 12 μm.

Production Examples 2 to 13

Preparation of Resin Particles 2 to 13

The resin particles were prepared in the same manner as in Production Example 1 except that at least one of the added amount in parts by mass of the colloidal silica, and the type and the added parts by mass of the polymerizable monomer was altered according to the conditions shown in Table 1. The prepared resin particles were classified in the same manner as in Production Example 1 to yield the resin particles 2 to 13 each having the average particle size shown in able 1.

TABLE 1

| Production Example | Particles No. | Amount used of colloidal silica (parts by mass) | Polymerizable monomer and amount used thereof (parts by mass) | Average particle size [μm] |
|---|---|---|---|---|
| 1 | Resin Particles 1 | 9 | Acrylonitrile 50-methacrylonitrile 45-methyl acrylate 5 | 12 |
| 2 | Resin Particles 2 | 4.5 | Acrylonitrile 50-methacrylonitrile 45-methyl acrylate 5 | 50 |

TABLE 1-continued

| Production Example | Particles No. | Amount used of colloidal silica (parts by mass) | Polymerizable monomer and amount used thereof (parts by mass) | Average particle size [μm] |
|---|---|---|---|---|
| 3 | Resin Particles 3 | 9 | Acrylonitrile 80-metharylonitrile 20 | 10 |
| 4 | Resin Particles 4 | 4.5 | Acrylonitrile 80-metharylonitrile 20 | 30 |
| 5 | Resin Particles 5 | 9 | Methacrylonitrile 45-methyl acrylate 55 | 15 |
| 6 | Resin Particles 6 | 4.5 | Methacrylonitrile 45-methyl acrylate 55 | 40 |
| 7 | Resin Particles 7 | 9 | Acrylamide 45-methacrylamide 55 | 15 |
| 8 | Resin Particles 8 | 4.5 | Acrylamide 45-methacrylamide 55 | 40 |
| 9 | Resin Particles 9 | 9 | Acrylamide 100 | 8 |
| 10 | Resin Particles 10 | 9 | Methacrylamide 100 | 15 |
| 11 | Resin Particles 11 | 9 | Methyl methacrylate 100 | 10 |
| 12 | Resin Particles 12 | 9 | Acrylonitrile 100 | 15 |
| 13 | Resin Particles 13 | 9 | Vinylidene chloride 100 | 15 |

Production Example 14

Preparation of Electroconductive Rubber Composition 1

To 100 parts by mass of acrylonitrile butadiene rubber (NBR) (trade name: N230SV, manufactured by JSR Corp.), other four components shown under the heading of the component (1) in Table 2 presented below were added, and the resulting mixture was kneaded with a mixer regulated at 50° C. for 15 minutes. Next, the three components shown under the heading of the component (2) in Table 2 were added to the kneaded mixture, and the mixture was kneaded with a two-roll mill cooled to a temperature of 25° C. for 10 minutes, to yield the electroconductive rubber composition 1.

TABLE 2

| | Materials | Amount used (parts by mass) |
|---|---|---|
| Component (1) | Acrylonitrile butadiene rubber (NBR) (trade name: N230SV, manufactured by JSR Corp.) | 100 |
| | Carbon black (trade name: Tokablack #7360SB, manufactured by Tokai Carbon Co., Ltd.) | 48 |
| | Zinc oxide (trade name: Zinc white type 2, manufactured by Sakai Chemical Industry Co., Ltd.) | 5 |
| | Zinc stearate (trade name: SZ-2000, manufactured by Sakai Chemical Industry Co., Ltd.) | 1 |

TABLE 2-continued

| | Materials | Amount used (parts by mass) |
|---|---|---|
| | Calcium carbonate (trade name: Nanox #30, manufactured by Maruo Karushiumu Kabushiki Gaisha) | 20 |
| Component (2) | Resin Particles 1 | 12 |
| | Sulfur (vulcanizing agent) | 1.2 |
| | Tetrabenzylthiuram disulfide (TBzTD) (trade name: Perkacit TBzTD, manufactured by Flexis S.A.) (vulcanization promoter) | 4.5 |

Production Example 15

Preparation of Electroconductive Rubber Composition 2

To 100 parts by mass of a styrene butadiene rubber (SBR) (trade name: Tufdene 2003, manufactured by Asahi Kasei Corp.), the other six components shown under the heading of the component (1) in Table 3 presented below were added, and the resulting mixture was kneaded with a sealed type mixer regulated at 80° C. for 15 minutes. Next, the four components shown under the heading of the component (2) in Table 3 were added to the kneaded mixture, and the mixture was kneaded with a two-roll mill cooled to a temperature of 25° C. for 10 minutes, to yield the electroconductive rubber composition 2.

TABLE 3

| | Materials | Amount used (parts by mass) |
|---|---|---|
| Component (1) | Styrene butadiene rubber (SBR) (trade name: Tufdene 2003, manufactured by Asahi Kasei Corp.) | 100 |
| | Zinc oxide (trade name: Zinc white type 2, manufactured by Sakai Chemical Industry Co., Ltd.) | 5 |
| | Zinc stearate (trade name: SZ-2000, manufactured by Sakai Chemical Industry Co., Ltd.) | 1 |
| | Carbon black (trade name: Ketjen black EC600JD, manufactured by Lion Corp.) | 8 |
| | Carbon black (trade name: Seast 5, manufactured by Tokai Carbon Co., Ltd.) | 40 |
| | Calcium carbonate (trade name: Nanox #30, manufactured by Maruo Karushiumu Kabushiki Gaisha) | 15 |
| | Paraffin oil (trade name: PW380, manufactured by Idemitsu Kosan Co., Ltd.) | 20 |

TABLE 3-continued

| | Materials | Amount used (parts by mass) |
|---|---|---|
| Component (2) | Resin Particles 1 | 12 |
| | Sulfur (vulcanizing agent) | 1.2 |
| | Dibenzothiazyl disulfide (DM) (trade name: Nocceler DM, manufactured by Ouchi Shinko Chemical Industrial Co., Ltd., vulcanization promoter) | 1 |
| | Tetramethylthiuram monosulfide (TS) (trade name: Nocceler TS, manufactured by Ouchi Shinko Chemical Industrial Co., Ltd., vulcanization promoter) | 1 |

Production Example 16

Preparation of Electroconductive Rubber Composition 3

The electroconductive rubber composition 3 was obtained in the same manner as in Production Example 14 except that acrylonitrile butadiene rubber in Production Example 14 was replaced with butadiene rubber (BR) (trade name: JSR BR01, manufactured by JSR Corp.) and the amount of carbon black was altered to 30 parts by mass.

Production Example 17

Preparation of Electroconductive Rubber Composition 4

To 100 parts by mass of ethylene propylene diene copolymer (EPDM) (trade name: EP33, manufactured by JSR Corp.), the other four components shown under the heading of the component (1) in Table 4 presented below were added, and the resulting mixture was kneaded with a sealed type mixer regulated at 80° C. for 15 minutes. Next, the four components shown under the heading of the component (2) in Table 4 were added to the kneaded mixture, and the mixture was kneaded with a two-roll mill cooled to a temperature of 25° C. for 10 minutes, to yield the electroconductive rubber composition 4.

TABLE 4

| | Materials | Amount used (parts by mass) |
|---|---|---|
| Component (1) | Ethylene-propylene-diene copolymer (EPDM) (trade name: EP33, manufactured by JSR Corp.) | 100 |
| | Carbon black (trade name: Tokablack #7360SB, manufactured by Tokai Carbon Co., Ltd.) | 40 |
| | Zinc oxide (trade name: Zinc white type 2, manufactured by Sakai Chemical Industry Co., Ltd.) | 5 |
| | Zinc stearate (trade name: SZ-2000, manufactured by Sakai Chemical Industry Co., Ltd.) | 1 |
| | Calcium carbonate (trade name: Nanox #30, manufactured by Maruo Karushiumu Kabushiki Gaisha) | 20 |
| Component (2) | Resin Particles 1 | 12 |
| | Sulfur (vulcanizing agent) | 1 |
| | Dibenzothiazyl disulfide (DM) (trade name: Nocceler DM, manufactured by Ouchi Shinko Chemical Industrial Co., Ltd., vulcanization promoter) | 1 |
| | Tetramethylthiuram monosuifide (TS) (trade name: Nocceler TS, manufactured by Ouchi Shinko Chemical Industrial Co., Ltd., vulcanization promoter) | 1 |

Production Example 18

Preparation of Electroconductive Rubber Composition 5

To 100 parts by mass of epichlorohydrin rubber (EO-EP-AGE terpolymer compound, EO/EP/AGE=73 mol %/23 mol %/4 mol %), the other seven components shown under the heading of the component (1) in Table 5 presented below were added, and the resulting mixture was kneaded with a sealed type mixer regulated at 80° C. for 15 minutes. Next, the four components shown under the heading of the component (2) in Table 5 were added to the kneaded mixture, and the mixture was kneaded with a two-roll mill cooled to a temperature of 25° C. for 10 minutes, to yield the electroconductive rubber composition 5.

TABLE 5

| | Materials | Amount used (parts by mass) |
|---|---|---|
| Component (1) | Epichlorohydrin rubber (EO-EP-AGE terpolymer compound, EO/EP/AGE = 73 mol %/23 mol %/4 mol %) | 100 |
| | Carbon black (trade name: Thermax Flow Form N990, manufactured by Cancarb Ltd.) | 2 |
| | Zinc oxide (trade name: Zinc white type 2, manufactured by Sakai Chemical Industry Co., Ltd.) | 5 |
| | Zinc stearate (trade name: SZ-2000, manufactured by Sakai Chemical Industry Co., Ltd.) | 1 |
| | Calcium carbonate (trade name: Nanox #30, manufactured by Maruo Karushiumu Kabushiki Gaisha) | 20 |
| | Adipic acid ester (trade name: (Polycizer W305ELS, manufactured by Dainippon Ink and Chemicals, Inc.) | 8 |
| | Quaternary ammonium salt (trade name: Adeka Sizer LV70, manufactured by Asahi Denka Kogyo Co., Ltd.) | 2 |
| | 2-Mercaptobenzimidazole (anti-aging agent) | 0.5 |
| Component (2) | Resin particles 1 | 12 |
| | Sulfur (vulcanizing agent) | 1 |
| | Dibenzothiazyl disulfide (DM) (trade name: Nocceler DM, manufactured by Ouchi Shinko Chemical Industrial Co., Ltd., vulcanization promoter) | 1 |
| | Tetramethylthiuram monosulfide (TS) (trade name: Nocceler TS, manufactured by Ouchi Shinko Chemical Industrial Co., Ltd., vulcanizition promoter) | 1 |

Example 1

As shown in FIG. 3A, Example 1 relates to a roller member having an electroconductive elastic layer on an electroconductive substrate.

[1. Electroconductive Substrate]

A thermosetting resin containing 10% by mass of carbon black is applied on a stainless steel substrate of 6 mm in diameter and 252.5 mm in length and dried; the thus treated substrate was used as an electroconductive substrate.

[2. Formation of Electroconductive Elastic Layer]

By using an extrusion molding apparatus equipped with a cross head die, the outer peripheral surface of the conductive substrate was coated with the electroconductive rubber composition 1 prepared in Production Example 14, in a cylindrical shape with the electroconductive substrate serving as a central axis. The coating thickness of the electroconductive rubber composition was regulated to be 1.75 mm.

The roller after treating with the extrusion molding apparatus was heated in a hot air furnace at 160° C. for 1 hour to vulcanize the electroconductive rubber composition, and then the ends of the rubber layer was removed to regulate the length of the rubber layer to be 224.2 mm. Additionally, a secondary vulcanization was performed at 160° C. for 1 hour, to prepare a roller having a preliminary coating layer of 3.5 mm in layer thickness. The obtained outer peripheral surface of the roller was polished with a plunge cutting type cylinder polishing machine. As the polishing abrasive grain, a vitrified grinding stone was used, and the abrasive grain is made of a green silicon carbide (GC) and the particle size was set at 100 mesh. The number of rotations of the roller was set at 350 rpm, and the number of rotations of the grinding wheel was set at 2050 rpm. The cutting speed was set at 20 mm/min, the spark-out time (the time at cutting of 0 mm) was set at 0 second, and the polishing was performed to prepare an electroconductive roller having an electroconductive elastic layer. The thickness of the electroconductive elastic layer was regulated to be 1.5 mm. The crown quantity of the resulting roller was found to be 120 μm.

[3. Irradiation of Electroconductive Elastic Layer with Electron Beam]

The electroconductive roller was irradiated with electron beam under the following conditions to yield the roller member 1. The electron beam irradiation was performed with an electron beam irradiation apparatus (trade name: low energy electron beam irradiation source EB-ENGINE, manufactured by Hamamatsu Photonics K.K.). The irradiation with electron beam was performed in such a way that the oxygen concentration of the atmosphere was regulated to be 500 ppm or less by nitrogen gas purge, and while the roller member was being rotated at 300 rpm with the electroconductive substrate of the roller member as a rotation axis, the roller member was conveyed at a processing speed of 10 mm/s in the direction perpendicular to the plane of FIG. 8. The electron beam irradiation conditions were such that the acceleration voltage was 70 kV, and the electronic current was regulated so as for the dose to be 1000 kGy.

[4. Evaluation of Roller Member]

In the roller member 1 thus obtained were evaluated with respect to the following [4-1] to [4-6]. The evaluation results thus obtained are shown in Table 11 and Table 13.

[4-1. Measurements of Surface Roughness Rzjis and Mean Concave-Convex Spacing Sm of Roller Member]

The surface roughness and the mean concave-convex spacing are measured according to the surface roughness standards of JIS B 0601-1994 by using a surface roughness tester (trade name: SE-3500, manufactured by Kosaka Laboratory Ltd.). The surface roughness values and the concave-convex spacings are measured at randomly selected six positions on the surface of the roller member, and the average values of the surface roughness and the concave-convex spacing are adopted as Rzjis and Sm. It is to be noted that the cut-off value is 0.8 mm and the evaluation length is 8 mm.

[4-2. Shape Measurement of Bowl-Shaped Resin Particles]

The arbitrary points on the electroconductive elastic layer are cut every 20 nm over 500 μm with a focused ion beam (trade name: FB-2000C, manufactured by Hitachi, Ltd.), the cross sectional images at these points are photographed. By combining the photographed images of one and the same bowl-shaped resin particle, the three-dimensional image of the bowl-shaped resin particle is derived. From the three-dimensional image, "the maximum diameter" 55 is derived as shown in FIG. 6A to FIG. 6E, and "the minimum diameter of the opening" 63 shown in FIG. 6A to FIG. 6E are derived. From the three-dimensional image, at arbitrary five points on the bowl-shaped resin particles, "the difference between the outer diameter and the inner diameter" (namely, "the thickness of the shell") is derived. Such operations as described above are performed for the 10 resin particles within the field of view. The same measurement is performed at 10 positions in the lengthwise direction of the roller member, and the average value is derived for the values derived for the 100 resin particles thus obtained in total.

[4-3. Measurement of Surface Profile of Roller Member]

The surface of the roller member is observed with a laser microscope (trade name: LXM5 PASCAL, manufactured by Carl Zeiss Ltd.) in a field of view of 0.5 mm in length and 0.5 mm in width. By scanning the laser on the X-Y plane within the field of view, a two-dimensional image data is obtained, and then the focal point is moved in the Z direction and the foregoing scanning is repeated; in this way a three-dimensional image data is obtained. Consequently, first, it is verified that the bowl-shaped resin particles have the concavities derived from the openings and the protrusions derived from the edges. Additionally, "the height difference" 54 between the top of the protrusion 53 and the bottom of the concavity 52 is derived. Such an operation is performed for the two bowl-shaped resin particles within the field of view. The same measurement is performed at 50 positions in the lengthwise direction of the roller member, and the average value of the measured values of the 100 resin particles obtained in total is derived.

[4-4. Measurement of Restoring Rate for Elastic Deformation of Roller Member]

Based on ISO 14577, the restoring rate was measured with the Picodentor HM500 (trade name, manufactured by Fischer Instruments KK). As the indenter, an indenter (Vickers pyramid) was used which is a pyramid-type diamond indenter having a square base and angle of 136° between the opposite faces at the vertex. The measurement was performed in the middle and at both ends (each 90 mm from the middle toward the end) in the lengthwise direction.

The measurement includes a step (hereinafter, referred to as an "indentation step") of indenting the indenter at a predetermined speed to a predetermined depth, and a step (hereinafter, referred to as a "unloading step") of unloading the load from the position of the predetermined indentation depth at a predetermined speed. From the load-displacement curve thus obtained as shown in FIG. 12, the restoring rate for the elastic deformation was derived. The method for deriving the restoring rate is described below.

The measurement was performed under the following two conditions, and in the case where there was a region where the bowl-shaped resin particles were absent, a non-resin particle portion was selected. It is to be noted that FIG. 12 shows an example of the load-displacement curve in the case of t=100 μm in the <condition 2>.

<Condition 1> Measurement of Restoring Rate on Surface (Indentation Step)

Maximum indentation depth=10 μm

Indentation time=20 seconds

It is to be noted that the maximum load $F_{max}$ was required to be sufficiently large so as to enable the indentation to the maximum indentation depth, and thus set at 10 mN in the present measurement.

(Unloading Step)

Minimum load=0.005 mN

Unloading time=1 second

It is to be noted that the unloading was performed until the minimum load of the indenter was reached.

The restoring rate v for the elastic deformation was derived from the displacement (=the restored distance L of the electroconductive elastic layer) of the indenter at 0.1 second form the start of the unloading in the unloading step, with the following formula:

$$\text{Restoring rate } v = L/0.1$$

<Condition 2> Measurement of Restoring Rate at Predetermined Depth t μm (Indentation Step)

Maximum indentation depth (predetermined depth t)=20, 30, 50, 100 μm

Indentation time=20 seconds

It is to be noted that the maximum load was required to be a sufficiently large value so as to enable the indentation to the maximum indentation depth, and thus set at 300 mN in the present measurement.

(Unloading Step)

Minimum load=0.005 mN

Unloading time=(maximum indentation depth)/10 sec

The unloading was performed until the minimum load of the indenter was reached. The unloading time is determined by the maximum indentation depth in the indentation step; for example, in the case of the maximum indentation depth t=20 μm, the unloading time is 2 seconds. This is for the purpose of equalizing the unloading rates of the condition 1 and the condition 2. The derivation of the restoring rate v for the elastic deformation was performed in the same manner as in the case of the condition 1.

[4-5. Image Evaluation 1] Evaluation of Abrasion Property

The monochromatic laser printer ("LaserJet P4515n" (trade name), manufactured by Hewlett-Packard Japan, Ltd.), which is an electrophotographic apparatus having the configuration shown in FIG. 10, was used and a voltage was applied to the charging roller from the outside. The applied voltage was an alternating-current voltage, and the peak-to-peak voltage (Vpp) was set at 1800 V, the frequency (f) was set at 2930 Hz, and the direct-current voltage (Vdc) was set at −600 V. The output image resolution was 600 dpi. As the process cartridge, a process cartridge for the foregoing printer was used. The attached charging roller was dismounted from process cartridge, and the roller member 1 was set as the charging roller. The roller member 1 was made to come into contact with the electrophotographic photosensitive member with a pushing pressure of 4.9 N due to a spring at one end and a total pushing pressure of 9.8 N due to springs at both ends. The roller member 1 was set in the process cartridge, and the process cartridge was preconditioned in a high-temperature and high-humidity environment of a temperature of 32.5° C. and a relative humidity of 80% for 24 hours.

Next, the following image evaluation was performed. First, a two-sheet intermittent print endurance test (an endurance test in which the rotation of the printer was stopped every two output sheets for 3 seconds) was performed in which a horizontal-line image of two dots in width and 176 dots in spacing was output in the direction perpendicular to the rotational direction of the electrophotographic photosensitive member. After the output of 20000 printed sheets, a halftone image (in the direction perpendicular to the rotational direction of the electrophotographic photosensitive member, an image depicting a horizontal line of one dot in width and two dots in spacing) was output and evaluated. In the evaluation, the halftone image was visually observed and whether or not a dot-like, a horizontal line-like, or a vertical line-like image defect due to the uneven abrasion of the photosensitive member was found was evaluated based on the following standards.

TABLE 6

| Rank | Evaluation standard |
|---|---|
| 1 | No dot-like, holizontal line-like and vertical line-like image defects are found. |
| 2 | Dot-like, holizontal line-like and vertical line-like image defects are slightly found. |
| 3 | Dot-like and holizontal line-like defects are found to occur in a manner corresponding to the rotation pitch of the roller member. Vertical line-like image defects are also partially found. |
| 4 | Dot-like, holizontal line-like and vertical line-like image defects are conspicuous |

[4-6. Image Evaluation 2] Evaluation of Occurrence State of Banding

The process cartridge was preconditioned in a low-temperature and low-humidity environment of a temperature of 15° C. and a relative humidity of 10% for 24 hours, and then an evaluation was performed with the same electrophotographic apparatus and under the same voltage application condition as in the evaluation of the abrasion property in the image evaluation 1.

After the output of 20000 printed sheets, a halftone image (in the direction perpendicular to the rotational direction of the electrophotographic photosensitive member, an image depicting a horizontal line of one dot in width and two dots in spacing) was output. Then, the resulting halftone image was visually observed and whether or not the banding, namely, a horizontal line-like density unevenness due to the uneven charging was found was evaluated based on the following standards.

TABLE 7

| Rank | Evaluation standard |
|---|---|
| 1 | No banding occurs. |
| 2 | Only slight banding is found. |
| 3 | Banding is partially found with the rotation pitch of the roller member, but causes no problem in practical use. |
| 4 | Banding is conspicuous, and the image quality degradation is found. |

Examples 2 to 10, 13 to 32, 34 to 40, 42 to 48, and 50 to 56

At least one of the following items was altered to the condition shown in Table 9: the type and the added number of parts of the resin particles, the type of the electroconductive rubber composition, the cutting speed at the time of polishing, the crown quantity of the electroconductive elastic layer, the electron beam dose in the electron beam irradiation, and the electron acceleration voltage in the electron beam irradiation. Otherwise, in the same manner as in Example 1, roller members 2 to 10, 13 to 32, 34 to 40, 42 to 48, and 50 to 56 were prepared.

Example 11

A roller member 11 was prepared in the same manner as in Example 1 except that the method of the electron beam irradiation was altered to the following method.

In performing the electron beam irradiation, the surface of the electroconductive elastic layer was coated by placing a 100-μm thick stainless steel sheet on the central part exclusive of both ends each having a width of 15 mm, of the length of 224.2 mm in the lengthwise direction of the electroconductive elastic layer of the electroconductive roller. In this state, the surface of the electroconductive elastic layer was irradiated with an electron beam having an acceleration voltage of 80 kV, by using an area-type electron beam irradiation source (trade name: EC150/45/40 mA, manufactured by Iwasaki Electric Co., Ltd.), and thus both ends each having a width of 15 mm of the electroconductive elastic layer were surface-treated.

Next, each of the areas of the electroconductive elastic layer exclusive of the areas each extending from 15 mm to 30 mm from the end concerned in the lengthwise direction of the electroconductive elastic layer was coated with a stainless steel sheet, and the areas each extending from 15 mm to 30 mm from the end concerned in the lengthwise direction of the electroconductive elastic layer were irradiated with an electron beam having an acceleration voltage of 90 kV.

Next, each of the areas of the electroconductive elastic layer exclusive of the areas each extending from 30 mm to 45 mm from the end concerned in the lengthwise direction of the electroconductive elastic layer was coated with a stainless steel sheet, and the areas each extending from 30 mm to 45 mm from the end concerned in the lengthwise direction of the electroconductive elastic layer were irradiated with an electron beam having an acceleration voltage of 100 kV.

Next, each of the areas of the electroconductive elastic layer exclusive of the areas each extending from 45 mm to 60 mm from the end concerned in the lengthwise direction of the electroconductive elastic layer was coated with a stainless steel sheet, and the areas each extending from 45 mm to 60 mm from the end concerned in the lengthwise direction of the electroconductive elastic layer were irradiated with an electron beam having an acceleration voltage of 110 kV.

Next, each of the areas of the electroconductive elastic layer exclusive of the areas each extending from 60 mm to 75 mm from the end concerned in the lengthwise direction of the electroconductive elastic layer was coated with a stainless steel sheet, and the areas each extending from 60 mm to 75 mm from the end concerned in the lengthwise direction of the electroconductive elastic layer were irradiated with an electron beam having an acceleration voltage of 120 kV.

Next, each of the areas of the electroconductive elastic layer exclusive of the areas each extending from 75 mm to 90 mm from the end concerned in the lengthwise direction of the electroconductive elastic layer was coated with a stainless steel sheet, and the areas each extending from 75 mm to 90 mm from the end concerned in the lengthwise direction of the electroconductive elastic layer were irradiated with an electron beam having an acceleration voltage of 130 kV.

Next, each of the areas of the electroconductive elastic layer exclusive of the areas each extending from 90 mm to 105 mm from the end concerned in the lengthwise direction of the electroconductive elastic layer was coated with a stainless steel sheet, and the areas each extending from 90 mm to 105 mm from the end concerned in the lengthwise direction of the electroconductive elastic layer were irradiated with an electron beam having an acceleration voltage of 140 kV.

Finally, each of the areas of the electroconductive elastic layer exclusive of the areas each extending over a width of 7.1 mm from the center toward the end concerned in the lengthwise direction of the electroconductive elastic layer (namely, the central area having a total width of 14.2 mm) was coated with a stainless steel sheet, and the area having the width of 14.2 mm was irradiated with an electron beam having an acceleration voltage of 150 kV.

By applying a nitrogen gas purge to the atmosphere at the time of irradiation, the oxygen concentration of the atmosphere was regulated to be 500 ppm or less, and while the electroconductive roller was being rotated at 500 rpm, the electroconductive roller was conveyed in the direction perpendicular to the plane of FIG. 9 at a processing speed of 10 mm/sec. The electron beam irradiation conditions were such that the electronic current was regulated so as for the dose at each of the acceleration voltages to be 1000 kGy.

Example 12

A roller member 12 was prepared in the same manner as in Example 11 except that the resin particles 1 were replaced with the resin particles 2.

Examples 33, 41, 49 and 57

Roller members 33, 41, 49 and 57 were prepared in the same manner as in Example 1 except that the electroconductive rubber composition 1 was replaced with the electroconductive rubber compositions shown in Table 9, respectively.

Table 9 collects, for the roller members No. 1 to 57 according to Examples 1 to 57, the sequential numbers of the electroconductive rubber compositions and the sequential numbers and the parts by mass of the resin particles, the polishing conditions, the crown quantities and the electron beam irradiation conditions used for the production of these roller members. Tables 11 and 13 show the evaluation results of the roller members according to individual Examples.

Comparative Example 1

A roller member 58 was prepared in the same manner as in Example 1 except that no electron beam irradiation was performed.

Comparative Example 2

A roller member 59 was prepared in the same manner as in Example 1 except that the electron beam irradiation method was altered to the following method. The electron beam irradiation was performed with an area-type electron beam irradiation source (trade name: EC150/45/40 mA, manufactured by Iwasaki Electric Co., Ltd.). The irradiation with electron beam was performed in such a way that the oxygen concentration of the atmosphere was regulated to be 500 ppm or less by nitrogen gas purge, and while the electroconductive roller member was being rotated at 500 rpm with the electroconductive substrate as a rotation axis, the roller member was conveyed at 10 mm/sec. The electron beam irradiation conditions were such that the acceleration voltage was 80 kV, and the electronic current was regulated so as for the dose to be 1000 kGy.

Comparative Example 3

A roller member 60 was prepared in the same manner as in Comparative Example 2 except that the electron acceleration voltage in the electron beam irradiation was altered from 80 kV to 150 kV.

Comparative Example 4

A roller member 61 was prepared in the same manner as in Example 50 except that an electroconductive elastic layer was prepared by adding no resin particles and by performing no electron beam irradiation, and then an electroconductive surface layer was prepared by the following method.

[Method for Forming Electroconductive Surface Layer]

To a caprolactone-modified acrylic polyol solution "Placcel DC2016" (trade name, manufactured by Daicel Chemical industries, Ltd.), methyl isobutyl ketone was added so as to regulate the solid content of the resulting solution to be 10% by mass. To 1000 parts by mass (acrylic polyol solid content: 100 parts by mass) of the solution, other three components shown in Table 8 were added to prepare a mixed solution.

TABLE 8

| Materials | Amount used (parts by mass) |
|---|---|
| Caprolactone-modified acrylic polyol solution "Placcel DC2016" trade name, manufactured by Daicel Chemical Industries, Ltd.) | 100 |
| Carbon black (trade name MA-100, manufactured by Mitsubishi Carbon Co., Ltd.) | 45 |
| Modified dimethyl silicone oil (trade name: SH28PA, manufactured by Dow Corning Toray Silicone Co., Ltd.) | 0.08 |
| Blocked isocyanate mixture (5:5 mixture of hexamethylene diisocyanate (HDI) and isophorone diisocyanate (IPDI) each blocked with butanone oxime) | 2 |

Next, in a glass bottle having an internal volume of 450 mL, 200 parts by mass of the foregoing mixed solution was placed together with 200 parts by mass of glass beads having an average particle size of 0.8 mm, and the mixed solution was dispersed with a paint shaker disperser for 24 hours. Subsequently, polymethyl methacrylate resin particles (average particle size: 20 μm) were added to the mixed solution, the resulting mixture was again dispersed for 5 minutes, and the glass beads were removed to prepare an electroconductive resin coating liquid.

An electroconductive roller having an electroconductive elastic layer having been subjected to polishing was immersed in the electroconductive resin coating liquid with the lengthwise direction of the electroconductive roller oriented vertically, and thus the electroconductive roller was coated by a dipping method. The coating conditions were such that the immersion time was set at 9 seconds, and the pulling speed from the electroconductive resin coating liquid was such that the initial speed was set at 20 mm/sec, the final speed was set at 2 mm/sec, and the speed was linearly varied as a function of time between the start and the termination. The resulting coated product was air-dried at normal temperature for 30 minutes, then dried in a hot-air circulation dryer at a temperature of 80° C. for 1 hour, and further dried at a temperature of 160° C. for 1 hour. In this way, the roller member 61 was prepared in which the surface layer was formed on the outer peripheral surface of the electroconductive elastic layer.

Comparative Example 5

A roller member 62 was prepared in the same manner as in Example 1 except that no resin particles were added, and 15 parts by mass of ADCA (azodicarbonamide) was added as a foaming agent.

Table 10 collects, for the roller members No. 58 to 62 according to Comparative Examples 1 to 5, the sequential numbers of the electroconductive rubber compositions and the sequential numbers and the parts by mass of the resin particles, the polishing conditions, the crown quantities and the electron beam irradiation conditions used for the production of these roller members. Tables 12 and 14 show the evaluation results of the roller members according to individual Comparative Examples.

TABLE 9

| Example | Roller member No. | Electroconductive rubber composition No. | Resin Particles: Particle No. | Resin Particles: Number of parts [phr] | Polishing conditions: Cutting speed [mm/min] | Polishing conditions: Crown quantity [μm] | Electron beam irradiation conditions: Irradiation Source | Electron beam irradiation conditions: Acceleration voltage [kV] | Electron beam irradiation conditions: Electron beam dose [kGy] |
|---|---|---|---|---|---|---|---|---|---|
| 1 | 1 | 1 | 1 | 12 | 20 | 120 | Scanning type (FIG. 8) | 70 | 1000 |
| 2 | 2 | 1 | 1 | 18 | 20 | 120 | Scanning type (FIG. 8) | 70 | 1000 |
| 3 | 3 | 1 | 2 | 12 | 20 | 120 | Scanning type (FIG. 8) | 70 | 1000 |
| 4 | 4 | 1 | 2 | 18 | 20 | 120 | Scanning type (FIG. 8) | 70 | 1000 |
| 5 | 5 | 1 | 1 | 12 | 20 | 120 | Scanning type (FIG. 8) | 70 | 500 |
| 6 | 6 | 1 | 1 | 12 | 20 | 120 | Scanning type (FIG. 8) | 70 | 2000 |
| 7 | 7 | 1 | 1 | 12 | 20 | 120 | Scanning type (FIG. 8) | 60 | 1000 |
| 8 | 8 | 1 | 1 | 12 | 20 | 120 | Scanning type (FIG. 8) | 50 | 1000 |
| 9 | 9 | 1 | 1 | 12 | 20 | 30 | Scanning type (FIG. 8) | 70 | 1000 |
| 10 | 10 | 1 | 1 | 12 | 20 | 200 | Scanning type (FIG. 8) | 70 | 1000 |
| 11 | 11 | 1 | 1 | 12 | 20 | 120 | Area type (FIG. 9) | 80-150 | 1000 |
| 12 | 12 | 1 | 2 | 12 | 20 | 120 | Area type (FIG. 9) | 80-150 | 1000 |
| 13 | 13 | 1 | 3 | 12 | 20 | 120 | Scanning type (FIG. 8) | 70 | 1000 |
| 14 | 14 | 1 | 4 | 12 | 20 | 120 | Scanning type (FIG. 8) | 70 | 1000 |
| 15 | 15 | 1 | 5 | 12 | 20 | 120 | Scanning type (FIG. 8) | 70 | 1000 |
| 16 | 16 | 1 | 6 | 12 | 20 | 120 | Scanning type (FIG. 8) | 70 | 1000 |
| 17 | 17 | 1 | 7 | 12 | 20 | 120 | Scanning type (FIG. 8) | 70 | 1000 |
| 18 | 18 | 1 | 8 | 12 | 20 | 120 | Scanning type (FIG. 8) | 70 | 1000 |
| 19 | 19 | 1 | 9 | 12 | 20 | 120 | Scanning type (FIG. 8) | 70 | 1000 |
| 20 | 20 | 1 | 10 | 12 | 20 | 120 | Scanning type (FIG. 8) | 70 | 1000 |
| 21 | 21 | 1 | 11 | 12 | 20 | 120 | Scanning type (FIG. 8) | 70 | 1000 |
| 22 | 22 | 1 | 12 | 12 | 20 | 120 | Scanning type (FIG. 8) | 70 | 1000 |
| 23 | 23 | 1 | 13 | 12 | 20 | 120 | Scanning type (FIG. 8) | 70 | 1000 |
| 24 | 24 | 1 | 4 | 12 | 20 | 120 | Scanning type (FIG. 8) | 70 | 1000 |
| 25 | 25 | 1 | 4 | 12 | 20 | 120 | Scanning type (FIG. 8) | 70 | 1000 |
| 26 | 26 | 2 | 1 | 12 | 20 | 120 | Scanning type (FIG. 8) | 70 | 1000 |
| 27 | 27 | 2 | 1 | 12 | 20 | 120 | Scanning type (FIG. 8) | 70 | 500 |
| 28 | 28 | 2 | 1 | 12 | 20 | 120 | Scanning type (FIG. 8) | 70 | 2000 |
| 29 | 29 | 2 | 1 | 12 | 20 | 120 | Scanning type (FIG. 8) | 60 | 1000 |
| 30 | 30 | 2 | 1 | 12 | 20 | 120 | Scanning type (FIG. 8) | 50 | 1000 |
| 31 | 31 | 2 | 1 | 12 | 20 | 30 | Scanning type (FIG. 8) | 70 | 1000 |
| 32 | 32 | 2 | 1 | 12 | 20 | 200 | Scanning type (FIG. 8) | 70 | 1000 |
| 33 | 33 | 2 | 1 | 12 | 20 | 120 | Area type (FIG. 9) | 80-150 | 1000 |
| 34 | 34 | 3 | 1 | 12 | 20 | 120 | Scanning type (FIG. 8) | 70 | 1000 |
| 35 | 35 | 3 | 1 | 12 | 20 | 120 | Scanning type (FIG. 8) | 70 | 500 |
| 36 | 36 | 3 | 1 | 12 | 20 | 120 | Scanning type (FIG. 8) | 70 | 2000 |
| 37 | 37 | 3 | 1 | 12 | 20 | 120 | Scanning type (FIG. 8) | 60 | 1000 |
| 38 | 38 | 3 | 1 | 12 | 20 | 120 | Scanning type (FIG. 8) | 50 | 1000 |
| 39 | 39 | 3 | 1 | 12 | 20 | 30 | Scanning type (FIG. 8) | 70 | 1000 |
| 40 | 40 | 3 | 1 | 12 | 20 | 200 | Scanning type (FIG. 8) | 70 | 1000 |
| 41 | 41 | 3 | 1 | 12 | 20 | 120 | Area type (FIG. 9) | 80-150 | 1000 |
| 42 | 42 | 4 | 1 | 12 | 20 | 120 | Scanning type (FIG. 8) | 70 | 1000 |
| 43 | 43 | 4 | 1 | 12 | 20 | 120 | Scanning type (FIG. 8) | 70 | 500 |
| 44 | 44 | 4 | 1 | 12 | 20 | 120 | Scanning type (FIG. 8) | 70 | 2000 |
| 45 | 45 | 4 | 1 | 12 | 20 | 120 | Scanning type (FIG. 8) | 60 | 1000 |
| 46 | 46 | 4 | 1 | 12 | 20 | 120 | Scanning type (FIG. 8) | 50 | 1000 |
| 47 | 47 | 4 | 1 | 12 | 20 | 30 | Scanning type (FIG. 8) | 70 | 1000 |
| 48 | 48 | 4 | 1 | 12 | 20 | 200 | Scanning type (FIG. 8) | 70 | 1000 |
| 49 | 49 | 4 | 1 | 12 | 20 | 120 | Area type (FIG. 9) | 80-150 | 1000 |
| 50 | 50 | 5 | 1 | 12 | 20 | 120 | Scanning type (FIG. 8) | 70 | 1000 |
| 51 | 51 | 5 | 1 | 12 | 20 | 120 | Scanning type (FIG. 8) | 70 | 500 |
| 52 | 52 | 5 | 1 | 12 | 20 | 120 | Scanning type (FIG. 8) | 70 | 2000 |
| 53 | 53 | 5 | 1 | 12 | 20 | 120 | Scanning type (FIG. 8) | 60 | 1000 |
| 54 | 54 | 5 | 1 | 12 | 20 | 120 | Scanning type (FIG. 8) | 50 | 1000 |
| 55 | 55 | 5 | 1 | 12 | 20 | 30 | Scanning type (FIG. 8) | 70 | 1000 |
| 56 | 56 | 5 | 1 | 12 | 20 | 200 | Scanning type (FIG. 8) | 70 | 1000 |
| 57 | 57 | 5 | 1 | 12 | 20 | 120 | Area type (FIG. 9) | 80-150 | 1000 |

TABLE 10

| Comparative Example | Roller member No. | Electroconductive rubber composition No. | Resin Particles: Particle No. | Resin Particles: Number of parts [phr] | Polishing conditions: Cutting speed [mm/min] | Polishing conditions: Crown quantity [μm] | Electron beam irradiation conditions: Irradiation Source | Electron beam irradiation conditions: Acceleration voltage [kV] | Electron beam irradiation conditions: Electron beam dose [kGy] |
|---|---|---|---|---|---|---|---|---|---|
| 1 | 58 | 1 | 1 | 12 | 20 | 120 | No electron beam irradiation | | |
| 2 | 59 | 1 | 1 | 12 | 20 | 120 | Area type (FIG. 9) | 80 | 1000 |

TABLE 10-continued

| Comparative Example | Roller member No. | Electroconductive rubber composition No. | Resin Particles: Particle No. | Resin Particles: Number of parts [phr] | Polishing conditions: Cutting speed [mm/min] | Polishing conditions: Crown quantity [μm] | Electron beam irradiation conditions: Irradiation Source | Electron beam irradiation conditions: Acceleration voltage [kV] | Electron beam irradiation conditions: Electron beam dose [kGy] |
|---|---|---|---|---|---|---|---|---|---|
| 3 | 60 | 1 | 1 | 12 | 20 | 120 | Area type (FIG. 9) | 150 | 1000 |
| 4 | 61 | 5 | — | — | 20 | 120 | — | | |
| 5 | 62 | 1 | Chemical foaming | | 20 | 120 | Scanning type (FIG. 8) | 70 | 1000 |

TABLE 11

| Example | Roller member No. | Surface roughness: Rzjis [μm] | Surface roughness: Sm [μm] | Height difference [μm] | Maximum diameter [μm] | Minimum diameter of opening [μm] | Thickness of shell [μm] |
|---|---|---|---|---|---|---|---|
| 1 | 1 | 20 | 80 | 22 | 28 | 27 | 0.5 |
| 2 | 2 | 22 | 60 | 23 | 29 | 28 | 0.5 |
| 3 | 3 | 52 | 101 | 60 | 100 | 98 | 0.8 |
| 4 | 4 | 50 | 84 | 62 | 102 | 100 | 0.8 |
| 5 | 5 | 20 | 80 | 22 | 28 | 27 | 0.5 |
| 6 | 6 | 20 | 80 | 22 | 28 | 27 | 0.5 |
| 7 | 7 | 20 | 80 | 22 | 28 | 27 | 0.5 |
| 8 | 8 | 20 | 80 | 22 | 28 | 27 | 0.5 |
| 9 | 9 | 21 | 79 | 23 | 28 | 27 | 0.5 |
| 10 | 10 | 19 | 82 | 21 | 28 | 27 | 0.5 |
| 11 | 11 | 20 | 80 | 22 | 28 | 27 | 0.5 |
| 12 | 12 | 52 | 98 | 64 | 100 | 98 | 0.8 |
| 13 | 13 | 19 | 75 | 20 | 24 | 22 | 1 |
| 14 | 14 | 44 | 90 | 50 | 70 | 68 | 0.6 |
| 15 | 15 | 27 | 84 | 29 | 35 | 34 | 0.5 |
| 16 | 16 | 49 | 96 | 56 | 90 | 88 | 0.8 |
| 17 | 17 | 29 | 84 | 32 | 38 | 35 | 1.2 |
| 18 | 18 | 48 | 95 | 54 | 88 | 82 | 1.8 |
| 19 | 19 | 15 | 68 | 16 | 18 | 15 | 1.2 |
| 20 | 20 | 30 | 86 | 33 | 38 | 34 | 1.8 |
| 21 | 21 | 18 | 74 | 20 | 22 | 15 | 3.6 |
| 22 | 22 | 28 | 84 | 32 | 36 | 32 | 1.8 |
| 23 | 23 | 29 | 85 | 33 | 37 | 34 | 1.5 |
| 24 | 24 | 36 | 90 | 40 | 60 | 58 | 0.6 |
| 25 | 25 | 50 | 90 | 56 | 80 | 78 | 0.6 |
| 26 | 26 | 22 | 78 | 24 | 30 | 29 | 0.5 |
| 27 | 27 | 22 | 78 | 24 | 30 | 29 | 0.5 |
| 28 | 28 | 22 | 78 | 24 | 30 | 29 | 0.5 |
| 29 | 29 | 22 | 78 | 24 | 30 | 29 | 0.5 |
| 30 | 30 | 22 | 78 | 24 | 30 | 29 | 0.5 |
| 31 | 31 | 22 | 78 | 24 | 30 | 29 | 0.5 |
| 32 | 32 | 22 | 78 | 24 | 30 | 29 | 0.5 |
| 33 | 33 | 22 | 78 | 24 | 30 | 29 | 0.5 |
| 34 | 34 | 24 | 74 | 28 | 32 | 31 | 0.5 |
| 35 | 35 | 24 | 74 | 28 | 32 | 31 | 0.5 |
| 36 | 36 | 24 | 74 | 28 | 32 | 31 | 0.5 |
| 37 | 37 | 24 | 74 | 28 | 32 | 31 | 0.5 |
| 38 | 38 | 24 | 74 | 28 | 32 | 31 | 0.5 |
| 39 | 39 | 24 | 74 | 28 | 32 | 31 | 0.5 |
| 40 | 40 | 24 | 74 | 28 | 32 | 31 | 0.5 |
| 41 | 41 | 24 | 74 | 28 | 32 | 31 | 0.5 |
| 42 | 42 | 25 | 73 | 29 | 33 | 32 | 0.5 |
| 43 | 43 | 25 | 73 | 29 | 33 | 32 | 0.5 |
| 44 | 44 | 25 | 73 | 29 | 33 | 32 | 0.5 |
| 45 | 45 | 25 | 73 | 29 | 33 | 32 | 0.5 |
| 46 | 46 | 25 | 73 | 29 | 33 | 32 | 0.5 |
| 47 | 47 | 25 | 73 | 29 | 33 | 32 | 0.5 |
| 48 | 48 | 25 | 73 | 29 | 33 | 32 | 0.5 |
| 49 | 49 | 25 | 73 | 29 | 33 | 32 | 0.5 |
| 50 | 50 | 28 | 68 | 29 | 37 | 36 | 0.5 |
| 51 | 51 | 28 | 68 | 29 | 37 | 36 | 0.5 |
| 52 | 52 | 28 | 68 | 29 | 37 | 36 | 0.5 |
| 53 | 53 | 28 | 68 | 29 | 37 | 36 | 0.5 |
| 54 | 54 | 28 | 68 | 29 | 37 | 36 | 0.5 |
| 55 | 55 | 28 | 68 | 29 | 37 | 36 | 0.5 |
| 56 | 56 | 28 | 68 | 29 | 37 | 36 | 0.5 |
| 57 | 57 | 28 | 68 | 29 | 37 | 36 | 0.5 |

TABLE 12

| Comparative Example | Roller member No. | Surface roughness Rzjis [μm] | Surface roughness Sm [μm] | Height difference [μm] | Maximum diameter [μm] | Minimum diameter of opening [μm] | Thickness of shell [μm] |
|---|---|---|---|---|---|---|---|
| 1 | 58 | 20 | 80 | 24 | 28 | 27 | 0.5 |
| 2 | 59 | 20 | 80 | 24 | 28 | 27 | 0.5 |
| 3 | 60 | 20 | 80 | 24 | 28 | 27 | 0.5 |
| 4 | 61 | 16 | 100 | — | — | — | — |
| 5 | 62 | 8 | 100 | — | — | — | — |

TABLE 13

| Example | Roller member No. | Restoring rate of elastic deformation [μm/sec] End in lengthwise direction Surface | 20 μm | 30 μm | 50 μm | 100 μm | Middle in lengthwise direction Surface | 20 μm | 30 μm | 50 μm | 100 μm | Image evaluations 1 Abrasion property | 2 Banding |
|---|---|---|---|---|---|---|---|---|---|---|---|---|---|
| 1 | 1 | 5.8 | 4.2 | 3.2 | 2.5 | 1 | 5.4 | 4.1 | 3.3 | 2.8 | 1.4 | 1 | 1 |
| 2 | 2 | 5.8 | 4.2 | 3.2 | 2.5 | 1 | 5.4 | 4.1 | 3.3 | 2.8 | 1.4 | 1 | 1 |
| 3 | 3 | 5.2 | 3.7 | 2.8 | 2 | 0.9 | 4.8 | 3.6 | 2.9 | 2.3 | 1.3 | 2 | 2 |
| 4 | 4 | 5.2 | 3.7 | 2.8 | 2 | 0.9 | 4.8 | 3.6 | 2.9 | 2.3 | 1.3 | 2 | 2 |
| 5 | 5 | 4.2 | 2.8 | 2 | 1.2 | 0.7 | 4 | 2.7 | 2 | 1.4 | 1 | 1 | 2 |
| 6 | 6 | 6.6 | 5 | 3.6 | 2.7 | 1.2 | 6 | 4.8 | 3.7 | 3 | 1.6 | 2 | 1 |
| 7 | 7 | 5.9 | 4 | 2.8 | 1.9 | 1 | 5.6 | 3.9 | 2.9 | 2.1 | 1.3 | 1 | 2 |
| 8 | 8 | 6 | 4.8 | 3.4 | 1.4 | 1.1 | 5.8 | 4.7 | 3.4 | 1.5 | 1.3 | 1 | 3 |
| 9 | 9 | 5.8 | 4.2 | 3.2 | 2.5 | 1 | 5.4 | 4.1 | 3.3 | 2.8 | 1.4 | 2 | 2 |
| 10 | 10 | 5.8 | 4.2 | 3.2 | 2.5 | 1 | 5.4 | 4.1 | 3.3 | 2.8 | 1.4 | 1 | 2 |
| 11 | 11 | 5.6 | 4.2 | 2.8 | 2.7 | 0.9 | 4.6 | 3.9 | 3.1 | 3.5 | 2.1 | 1 | 1 |
| 12 | 12 | 5.4 | 4 | 2.6 | 2.5 | 0.9 | 4.4 | 3.7 | 2.9 | 3.3 | 2.1 | 2 | 1 |
| 13 | 13 | 5.8 | 4.2 | 3.2 | 2.5 | 1 | 5.4 | 4.1 | 3.3 | 2.8 | 1.4 | 1 | 1 |
| 14 | 14 | 5.5 | 4.1 | 3 | 2.2 | 1 | 5.1 | 4 | 3.1 | 2.5 | 1.4 | 1 | 2 |
| 15 | 15 | 5.7 | 4.2 | 3.1 | 2.4 | 1 | 5.3 | 4.1 | 3.2 | 2.7 | 1.4 | 1 | 1 |
| 16 | 16 | 5.2 | 3.9 | 2.8 | 2 | 0.9 | 4.8 | 3.8 | 2.9 | 2.3 | 1.3 | 2 | 2 |
| 17 | 17 | 5.7 | 4 | 2.9 | 2.4 | 1.1 | 5.3 | 3.9 | 3 | 2.7 | 1.5 | 1 | 1 |
| 18 | 18 | 5.2 | 3.8 | 2.7 | 2 | 1 | 4.8 | 3.7 | 2.8 | 2.3 | 1.4 | 2 | 2 |
| 19 | 19 | 5.9 | 4.2 | 3.3 | 2.6 | 1.1 | 5.5 | 4.1 | 3.4 | 2.9 | 1.5 | 1 | 1 |
| 20 | 20 | 5.7 | 4 | 3.1 | 2.4 | 1 | 5.3 | 3.9 | 3.2 | 2.7 | 1.4 | 1 | 1 |
| 21 | 21 | 5.9 | 4.1 | 2.7 | 2.6 | 1 | 5.5 | 4 | 2.8 | 2.9 | 1.4 | 1 | 1 |
| 22 | 22 | 5.7 | 4 | 2.8 | 2.4 | 1 | 5.3 | 3.9 | 2.9 | 2.7 | 1.4 | 1 | 1 |
| 23 | 23 | 5.7 | 4.2 | 2.8 | 2.4 | 1.1 | 5.3 | 4.1 | 2.9 | 2.7 | 1.5 | 1 | 1 |
| 24 | 24 | 5.5 | 4.1 | 3 | 2.2 | 1 | 5.1 | 4 | 3.1 | 2.5 | 1.4 | 1 | 2 |
| 25 | 25 | 5.5 | 4.1 | 3 | 2.2 | 1 | 5.1 | 4 | 3.1 | 2.5 | 1.4 | 2 | 2 |
| 26 | 26 | 5.2 | 3.8 | 3 | 2.4 | 0.9 | 4.8 | 3.7 | 3.1 | 2.7 | 1.3 | 1 | 1 |
| 27 | 27 | 4 | 2.6 | 1.8 | 1.1 | 0.7 | 3.8 | 2.5 | 1.8 | 1.3 | 1 | 1 | 2 |
| 28 | 28 | 6.3 | 4.9 | 3.2 | 2.4 | 1 | 5.7 | 4.7 | 3.3 | 2.7 | 1.4 | 2 | 1 |
| 29 | 29 | 5.3 | 3.7 | 2.9 | 1.8 | 0.9 | 5 | 3.6 | 3 | 2 | 1.2 | 1 | 2 |
| 30 | 30 | 5.4 | 3.9 | 3 | 1.3 | 1 | 5.2 | 3.8 | 3 | 1.4 | 1.2 | 1 | 3 |
| 31 | 31 | 5.2 | 3.8 | 3 | 2.4 | 0.9 | 4.8 | 3.7 | 3.1 | 2.7 | 1.3 | 2 | 2 |
| 32 | 32 | 5.2 | 3.8 | 3 | 2.4 | 0.9 | 4.8 | 3.7 | 3.1 | 2.7 | 1.3 | 1 | 2 |
| 33 | 33 | 5 | 3.8 | 3 | 2.2 | 0.9 | 4 | 3.5 | 3.3 | 3 | 2.1 | 1 | 1 |
| 34 | 34 | 5 | 4 | 2.9 | 2.2 | 1 | 4.6 | 3.9 | 3 | 2.5 | 1.4 | 1 | 1 |
| 35 | 35 | 3.8 | 2.5 | 1.9 | 1 | 0.7 | 3.6 | 2.4 | 1.9 | 1.2 | 1 | 1 | 2 |
| 36 | 36 | 6.1 | 4.8 | 3 | 2.2 | 0.9 | 5.6 | 4.6 | 3.1 | 2.5 | 1.3 | 2 | 1 |
| 37 | 37 | 5.1 | 3.9 | 2.9 | 1.6 | 0.8 | 4.8 | 3.8 | 3 | 1.8 | 1.1 | 1 | 2 |
| 38 | 38 | 5.2 | 4 | 3 | 1.2 | 0.9 | 5 | 3.9 | 3 | 1.3 | 1.1 | 1 | 3 |
| 39 | 39 | 5 | 4 | 2.9 | 2.2 | 1 | 4.6 | 3.9 | 3 | 2.5 | 1.4 | 2 | 2 |
| 40 | 40 | 5 | 4 | 2.9 | 2.2 | 1 | 4.6 | 3.9 | 3 | 2.5 | 1.4 | 1 | 2 |
| 41 | 41 | 4.8 | 3.6 | 2.9 | 2.1 | 0.9 | 3.8 | 3.3 | 3.2 | 2.9 | 2.1 | 1 | 1 |
| 42 | 42 | 4.9 | 3.5 | 2.8 | 2.1 | 0.9 | 4.5 | 3.4 | 2.9 | 2.4 | 1.3 | 1 | 1 |
| 43 | 43 | 3.7 | 2.4 | 1.8 | 1 | 0.7 | 3.5 | 2.3 | 1.8 | 1.2 | 1 | 1 | 2 |
| 44 | 44 | 6 | 4.5 | 3.2 | 2.1 | 1.1 | 5.5 | 4.3 | 3.3 | 2.4 | 1.5 | 2 | 1 |
| 45 | 45 | 5 | 3.6 | 2.4 | 1.5 | 0.8 | 4.7 | 3.5 | 2.5 | 1.7 | 1.1 | 1 | 2 |
| 46 | 46 | 5.1 | 3.5 | 2.2 | 1.2 | 0.7 | 4.9 | 3.4 | 2.2 | 1.3 | 0.9 | 1 | 3 |
| 47 | 47 | 4.9 | 3.5 | 2.8 | 2.1 | 0.9 | 4.5 | 3.4 | 2.9 | 2.4 | 1.3 | 2 | 2 |
| 48 | 48 | 4.9 | 3.5 | 2.8 | 2.1 | 0.9 | 4.5 | 3.4 | 2.9 | 2.4 | 1.3 | 1 | 2 |
| 49 | 49 | 4.7 | 3.4 | 2.8 | 2.2 | 1.1 | 3.7 | 3.1 | 3.1 | 3 | 2.3 | 1 | 1 |
| 50 | 50 | 4.7 | 3.3 | 2.5 | 1.9 | 0.9 | 4.3 | 3.2 | 2.6 | 2.2 | 1.3 | 1 | 1 |
| 51 | 51 | 3.5 | 2.2 | 1.4 | 1 | 0.7 | 3.3 | 2.1 | 1.4 | 1.2 | 1 | 1 | 3 |
| 52 | 52 | 5.8 | 4.4 | 3 | 1.9 | 0.9 | 5.3 | 4.2 | 3.1 | 2.2 | 1.3 | 2 | 1 |
| 53 | 53 | 4.8 | 3.2 | 2.6 | 1.3 | 1 | 4.5 | 3.1 | 2.7 | 1.5 | 1.3 | 1 | 2 |
| 54 | 54 | 4.9 | 3.4 | 2.8 | 1.4 | 1.1 | 4.7 | 3.3 | 2.8 | 1.5 | 1.3 | 1 | 3 |
| 55 | 55 | 4.7 | 3.3 | 2.5 | 1.9 | 0.9 | 4.3 | 3.2 | 2.6 | 2.2 | 1.3 | 2 | 2 |

TABLE 13-continued

| Example | Roller member No. | Restoring rate of elastic deformation [μm/sec] End in lengthwise direction Surface | Depth from surface 20 μm | 30 μm | 50 μm | 100 μm | Middle in lengthwise direction Surface | Depth from surface 20 μm | 30 μm | 50 μm | 100 μm | Image evaluations 1 Abrasion property | 2 Banding |
|---|---|---|---|---|---|---|---|---|---|---|---|---|---|
| 56 | 56 | 4.7 | 3.3 | 2.5 | 1.9 | 0.9 | 4.3 | 3.2 | 2.6 | 2.2 | 1.3 | 1 | 2 |
| 57 | 57 | 4.5 | 3.2 | 2.7 | 2 | 1.1 | 3.5 | 2.9 | 3 | 2.8 | 2.3 | 1 | 1 |

TABLE 14

| Comparative Example | Roller member No. | Restoring rate of elastic deformation [μm/sec] End in lengthwise direction Surface | Depth from surface 20 μm | 30 μm | 50 μm | 100 μm | Middle in lengthwise direction Surface | Depth from surface 20 μm | 30 μm | 50 μm | 100 μm | Image evaluations 1 Abrasion property | 2 Banding |
|---|---|---|---|---|---|---|---|---|---|---|---|---|---|
| 1 | 58 | 1 | 0.9 | 1 | 0.9 | 0.9 | 1 | 0.9 | 1 | 0.9 | 0.9 | 3 | 4 |
| 2 | 59 | 5.6 | 4.2 | 2.8 | 2.7 | 0.9 | 5.6 | 4.2 | 2.8 | 2.7 | 0.9 | 1 | 4 |
| 3 | 60 | 4.6 | 3.9 | 3.1 | 3.5 | 2.1 | 4.6 | 3.9 | 3.1 | 3.5 | 2.1 | 1 | 4 |
| 4 | 61 | 5.7 | 4 | 2.8 | 1.6 | 1.2 | 5.7 | 4 | 2.8 | 1.6 | 1.2 | 4 | 4 |
| 5 | 62 | 0.6 | 0.6 | 0.5 | 0.6 | 0.5 | 0.6 | 0.6 | 0.5 | 0.6 | 0.5 | 4 | 4 |

The roller member according the present invention can alleviates the concentration of the contact pressure in a portion of the photosensitive member when the roller member is made to come into contact with the photosensitive member. Consequently, the non-uniform abrasion of the photosensitive member due to the contact of the roller member can be suppressed even in use over a long term. The roller member according to the present invention is improved in the follow-up rotation performance in relation to the photosensitive member. Consequently, the stick-slip is made to hardly occur, the charging unevenness of the photosensitive member and the occurrence of the banding image due to the charging unevenness can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-077702, filed Apr. 3, 2013, which is hereby incorporated by reference herein in its entirety.

What is claimed is:

1. A roller member for electrophotography comprising:

an electroconductive substrate and an electroconductive elastic layer as a surface layer;

wherein the electroconductive elastic layer has a crown shape of which an outer diameter at the middle of the roller member in the lengthwise direction is larger than those at both ends of the roller member;

the electroconductive elastic layer comprises a binder and a bowl-shaped resin particle;

the surface of the roller member has a concavity derived from an opening of the bowl-shaped resin particle and a protrusion derived from an edge of the opening of the bowl-shaped resin particle; and wherein the relation in the restoring rate of the roller member for elastic deformation between at the middle of the roller member in the lengthwise direction and at both ends of the roller member is such that:

on the surface of the electroconductive elastic layer, the restoring rate is larger at the both ends than that at the middle, and at the position of depth t μm from the surface of the electroconductive elastic layer, the restoring rate is larger at the middle than that at the both ends.

2. The roller member according to claim 1, wherein the restoring rate for elastic deformation becomes smaller in the depth direction from the surface of the electroconductive elastic layer.

3. The roller member according to claim 1, wherein the depth t μm is 30 μm or more and 100 μm or less.

4. The roller member according to claim 1, wherein the bowl-shaped resin particle has an opening and a roundish concavity demarcated by a shell.

5. The roller member according to claim 1, wherein the distance (height difference) between the top of the protrusion derived from the edge of the opening of the bowl-shaped resin particle and the bottom of the roundish concavity demarcated by the shell of the bowl-shaped resin particle is 5 μm or more and 100 μm or less.

6. The roller member according to claim 5, wherein the distance (height difference) between the top of the protrusion derived from the edge of the opening of the bowl-shaped resin particle and the bottom of the roundish concavity demarcated by the shell of the bowl-shaped resin particle is 8 μm or more and 80 μm or less.

7. The roller member according to claim 5, wherein the ratio between the maximum diameter of the bowl-shaped resin particle and the distance (height difference) between the top of the protrusion derived from the edge of the opening of the bowl-shaped resin particle and the bottom of the roundish concavity demarcated by the shell of the bowl-shaped resin particle, [maximum diameter]/[height difference] is 0.8 or more and 3.0 or less.

8. The roller member according to claim 1, wherein the maximum diameter of the bowl-shaped resin particle is 5 μm or more and 150 μm or less.

9. The roller member according to claim 8, wherein the maximum diameter of the bowl-shaped resin particle is 8 μm or more and 120 μm or less.

10. The roller member according to claim 1, wherein the thickness of the shell of the bowl-shaped resin particle is 0.1 μm or more and 3 μm or less.

11. The roller member according to claim 10, wherein the thickness of the shell of the bowl-shaped resin particle is 0.2 μm or more and 2 μm or less.

12. The roller member according to claim 1, wherein the ten-point average roughness (Rzjis) of the surface of the roller member is 5 μm or more and 65 μm or less.

13. The roller member according to claim 1, wherein the mean concave-convex spacing (Sm) of the surface of the roller member is 30 μm or more and 200 μm or less.

14. A process cartridge comprising the roller member for electrophotography according to claim 1 and an electrophotographic photosensitive member, and being constituted to be demountable from the body of an electrophotographic apparatus.

15. An electrophotographic apparatus comprising the roller member for electrophotography according to claim 1 and an electrophotographic photosensitive member.

* * * * *